US005552019A

United States Patent [19]

Weinstock et al.

[11] Patent Number: 5,552,019

[45] **Date of Patent: *Sep. 3, 1996**

[54] OXIDATIVE DELIGNIFICATION OF WOOD OR WOOD PULP BY TRANSITION METAL-SUBSTITUTED POLYOXOMETALATES

[75] Inventors: Ira A. Weinstock, Madison, Wis.; Craig L. Hill, Atlanta, Ga.

[73] Assignees: The United States of America as represented by the Secretary of Agriculture, Washington, D.C.; Emory University, Atlanta, Ga.

[ * ] Notice: The term of this patent shall not extend beyond the expiration date of Pat. No. 5,302,248.

[21] Appl. No.: 219,041

[22] Filed: Mar. 28, 1994

Related U.S. Application Data

[63] Continuation-in-part of Ser. No. 937,634, Aug. 28, 1992, Pat. No. 5,302,248.

[51] Int. Cl.[6] ..... D21C 3/00

[52] U.S. Cl. ..... 162/79; 530/506

[58] Field of Search ..... 162/65, 78, 79; 8/111, 107, 101; 530/500, 506

[56] References Cited

U.S. PATENT DOCUMENTS

| | | | |
|---|---|---|---|
| 2,779,656 | 1/1957 | Fennel et al. | 8/106 |
| 3,657,065 | 4/1972 | Smith et al. | 162/65 |
| 4,283,301 | 8/1981 | Diehl | 252/102 |
| 4,486,394 | 12/1984 | Nguyen | 423/155 |
| 4,773,966 | 9/1988 | Huynh | 162/78 |
| 4,839,008 | 6/1989 | Hill | 204/157.15 |
| 4,864,041 | 9/1989 | Hill | 549/513 |
| 4,892,941 | 1/1990 | Dolphin et al. | 540/145 |
| 4,931,207 | 6/1990 | Cramer et al. | 252/187.26 |
| 5,041,142 | 8/1991 | Ellis | 8/111 |
| 5,077,394 | 12/1991 | Dolphin et al. | 530/505 |

FOREIGN PATENT DOCUMENTS

| | | | |
|---|---|---|---|
| 1308096 | 9/1992 | Canada | C07C 29/48 |

OTHER PUBLICATIONS

Sattari, et al., *J. Chem. Soc., Chem. Commun.*, pp. 634–635 (1990).
Chambers, et al., 30 *Inorg. Chem.*, 2776–2781 (1991).
Ishii, et al., 53 *J. Org. Chem.* 3587–3593 (1988).
Ali, et al., *J. Chem. Soc., Chem. Commun.*, pp. 825–826 (1989).
Lyon, et al., 113 *J. Am. Chem. Soc.* 7209–7221 (1991).
Mansury, et al., 113 *J. Am. Chem. Soc.* 7222–7226 (1991).
Chambers, et al., 28 *Inorg. Chem.* 2509–2511 (1989).
Venturello, et al., 51 *J. Org. Chem.* 1599–1602 (1986).
Deutsch, et al., 62 *Tappi* 53–55 (1979).
Hill, et al., 108 *J. Am. Chem. Soc.* 536–538 (1986).
Finke, et al., 26 *Inorg. Chem.* 3886–3896 (1987).
Khenkin, et al., in *The Activation of Dioxygen and Homogeneous Catalytic Oxidation*, Barton, et al. (eds.), Plenum Press, New York, p. 463 (1993).
Gómez–García, et al., 32 *Inorg. Chem.* 3378–3381 (1993).

(List continued on next page.)

*Primary Examiner*—Donald E. Czaja
*Assistant Examiner*—Dean T. Nguyen
*Attorney, Agent, or Firm*—Janet I. Stockhausen; Howard M. Silverstein; John D. Fado

[57] ABSTRACT

A method for delignifying wood pulp and fiber is disclosed. The method comprises the steps of obtaining a wood pulp and exposing the wood pulp to a polyoxometalate of the formula $[V_lMo_mW_nNb_oTa_p(TM)_qX_rO_s]^{x-}$ where l is 0–18, m is . 0–40, n is 0–40, o is 0–10, p is 0–10, q is 0–9, r is 0–6, TM is a d-electron-containing transition metal ion, and X is a heteroatom, which is a p or d block element, where $l+m+n+o+p \geqq 4$, $l+m+q>0$ and s is sufficiently large that $x>0$. The exposure is under conditions wherein the polyoxometalate is reduced. In a preferable form of the invention, the method additionally comprises the step of reoxidizing the polyoxometalate.

13 Claims, 7 Drawing Sheets

OTHER PUBLICATIONS

Tourné, et al., *J. Chem. Soc. Dalton Trans.*, pp. 143–155 (1991).
Creaser, et al., 32 *Inorg. Chem.* 1573–1578 (1993).
Tourné, et al., 32 *J. Inorg. Nucl. Chem.* 3875–3890 (1970).
Weinstock, et al., *Proc. TAPPI Pulping Conf.*, pp. 519–532 (Nov. 1993).
Khehkin, et al., *Mendeleev Commun.*, pp. 140–141 (1993).
Smith, et al., *Svensk Papperstidning*, No. 12, pp. R106–R112 (1985).
Atalla, "The Polyoxometalates: New Bleaching Systems For The 21st Century", Abstract Drafted for Mar. 2, 1994 Talk at TAPPI Annual Meeting.

OXIDATIVE DELIGNIFICATION OF WOOD OR WOOD PULP BY TRANSITION METAL-SUBSTITUTED POLYOXOMETALATES

RELATED APPLICATIONS

This application is a continuation-in-part of U.S. Ser. No. 07/937,634, filed Aug. 28, 1992 now U.S. Pat. No. 5,302, 248, which is incorporated by reference as if fully set forth below.

FIELD OF THE INVENTION

The field of the present invention in general is the use of transition metal-derived agents in the delignification of wood or wood pulp. Specifically, the field of the present invention is the use of polyoxometalates in the delignification or bleaching of wood pulp.

BACKGROUND OF THE INVENTION

Pulping.

The transition of a tree into paper involves several discrete stages. Stage one is the debarking of the tree and the conversion of the tree into wood chips. Stage two is the conversion of wood chips into pulp. This conversion may be by either mechanical or chemical means.

Bleaching is the third stage. For chemical pulps, delignification is the first step in bleaching. Lignin, a complex polymer derived from aromatic alcohols, is one of the main constituents of wood. During the early stages of bleaching, residual lignin, which constitutes 3–6% of the pulp, is removed. Currently, this is typically done by treatment of the pulp with elemental chlorine at low pH, followed by extraction with hot alkali. Once a significant portion of the residual lignin has been removed, the pulp may be whitened, by a variety of means, to high brightness. Chlorine dioxide is commonly used in the brightening step.

Although chlorine compounds are effective and relatively inexpensive, their use in pulp mills results in the generation and release of chlorinated organic materials, including dioxins, into rivers and streams. Due to increasing regulatory pressures and consumer demand, new, non-chlorine bleaching technologies are urgently needed by manufacturers of paper-grade chemical pulps.

In recent years, attention has been drawn to the potential use of enzymatic processes associated with fungal degradation of lignin to develop environmentally friendly technologies for the pulp and paper industry. In many wood-rotting fungi, extracellular metalloenzymes such as glyoxal oxidase, a copper-containing oxidase, in combination with lignin and manganese peroxidases, both of which contain iron in a protoheme active site, harness the oxidative capability of dioxygen and direct its reactivity to the degradation of lignin within the fiber walls. In this biochemical process, high valent transition metal ions serve as conduits for the flux of electrons from lignin to oxygen.

Therefore, transition metal ions are known to possess redox properties that are useful in the delignification and bleaching of lignocellulosic materials. However, the behavior Of transition metal ions in water is often difficult to control. In aqueous solution, complex equilibria are established between ionic hydroxides and hydrates, as well as between accessible oxidation states of the metal ions. In addition, many transition metal oxides and hydroxides have limited solubilities in water, where the active metals are rapidly lost from solution as solid precipitates. What is needed in the art of pulp bleaching is a reusable transition metal-derived bleaching agent composed of relatively inexpensive and non-toxic materials that is suitable for use in a bleaching procedure.

Polyoxometalates.

Polyoxometalates are discrete polymeric structures that form spontaneously when simple oxides of vanadium, niobium, tantalum, molybdenum or tungsten are combined under the appropriate conditions in water (Pope, M. T. *Heteropoly and Isopoly Oxometalates* Springer-Verlag, Berlin, 1983). In a great majority of polyoxometalates, the transition metals are in the $d^0$ electronic configuration which dictates both high resistance to oxidative degradation and an ability to oxidize other materials such as lignin. The principal transition metal ions that form polyoxometalates are tungsten(VI), molybdenum(VI), vanadium(V), niobium(V) and tantalum(V).

Isopolyoxometalates, the simplest of the polyoxometalates, are binary oxides of the formula $[M_mO_y]^{p-}$, where m may vary from two to over 30. For example, if m=2 and M=Mo, then the formula is $[Mo_2O_7]^{2-}$; if m=6, then $[Mo_6O_{19}]^{2-}$; and if m=36, then $[Mo_{36}O_{112}]^{8-}$. Polyoxometalates, in either acid or salt forms, are water soluble and highly resistant to oxidative degradation.

Heteropolyoxometalates have the general formula $[X_xM_mO_y]^{p-}$ and possess a heteroatom, X, at their center. For example, in the α-Keggin structure, α-$[PW_{12}O_{40}]^{3-}$, X is a phosphorus atom. The central phosphorus atom is surrounded by twelve $WO_6$ octahedra.

Removal of a $(M{=}O)^{4+}$ moiety from the surface of the α-Keggin structure, α-$[PM_{12}O_{40}]^{3-}$, where M is molybdenum or tungsten, creates the "lacunary" α-Keggin anion, α-$[PM_{11}O_{39}]^{7-}$. The lacunary α-Keggin ion acts as a pentadentate ligand for redox active $d^0$ transition metal ions, such as vanadium(+5) in α-$[PVW_{11}O_{40}]^{4-}$ or molybdenum(+6) in α-$[PMoW_{11}O_{40}]^{3-}$, or for redox active, d-electron-containing transition metal ions (TM), such as manganese(+3) in α-$[PMnW_{11}O_{39}]^{4-}$. In the case of vanadium, further substitution is common, giving anions of the form $[X_xM'_mM_nO_y]^{p-}$, where m+n=12, such as α-$[PV_2Mo_{10}O_{40}]^{5-}$. The redox active vanadium(+5), molybdenum(+6) or d-electron-containing transition metal (TM) ions are bound at the surface of the heteropolyanion in much the same way that ferric ions are held within the active sites of lignin or manganese peroxidases. However, while stabilizing the metal ions in solution and controlling their reactivity, the heteropolyanions, unlike enzymes or synthetic porphyrins, are highly resistant to oxidative degradation (Hill, et al., *J. Am. Chem. Soc.* 108:536–538, 1986).

Previously, polyoxometalates have been used as catalysts for oxidation under heterogeneous and homogeneous conditions, analytical stains for biological samples, and for other uses still in development. In U.S. Ser. No. 07/939,634, the parent application of the present application, the use of vanadium(+5)-substituted polyoxometalates in delignification and pulp bleaching was described.

SUMMARY OF THE INVENTION

In the present invention a transition metal-substituted polyoxometalate is used as a delignification and bleaching agent. The metal in question must be sufficiently active to oxidize functional groups within lignin, residual lignin, and other chromophores of wood, wood pulp and other lignocellulosic fibers and pulp. The success of these polyoxometalates demonstrates that effective bleaching agents might be prepared by inclusion of a variety of d-electron-containing and other redox-active metal ions in the polyoxometalate structure.

The general formula for a polyoxometalate useful in the present invention is $[V_lMo_mW_nNb_oTa_p(TM)_qX_rO_s]^{x-}$ where l is 0–18, m is 0–40, n is 0–40, o is 0–10, p is 0–10, q is 0–9, r is 0–6, TM is a d-electron-containing transition metal ion, and X is a heteroatom, which is a p or d block element, provided that $l+m+n+o+p \geqq 4$, $l+m+q>0$, and s is sufficiently large that $x>0$. The present invention is a method of delignifying pulp comprising the steps of obtaining a wood pulp or wood fibers and exposing the wood pulp or wood fibers to a polyoxometalate of the above general formula under conditions wherein the polyoxometalate is reduced.

Preferably, wood pulp or fibers are exposed to a polyoxometalate of the formula $[V_lMo_mW_n(TM)_oX_pO_q]^{x-}$, where TM is any d-electron-containing transition metal ion, X is a heteroatom, which is a p or d block element, and either $l+m+n+o=12$, $o \leqq 4$, $p=1$ and $l+m+o>0$, or $l+m+n+o=22$, l+o is 1–4 and p=2; or where X is either $P^{5+}$, $As^{5+}$ or $S^{6+}$ and $l+m+n+o=18$, p=2 and $l+m+o>0$, or $m+n=30$, p=4 and o=4 and q is sufficiently lar that $x>0$.

Also preferably, wood pulp is exposed to a polyoxometalate of the formula $[V_lMo_mW_n(TM)_oP_5C_pNa_qO_r]^{x-}$, where TM is any d-electron-containing transition metal ion, C is a di- or tri-valent main group, transition metal or lanthanide cation located in the center of the structure, $l+m+n+o=30$, $p+q=1$ and $l+m+o>0$ and r is sufficiently large that $x>0$.

Other preferable forms of polyoxometalates include polyoxometalates of the formula $[V_nO_r]^{x-}$, where $n \geqq 4$, $r \geqq 12$ and $x=2r-5n$, or $[V_nMo_mW_o(MG)_p(TM)_qO_r]^{x-}$, where TM is any transition metal ion, MG is a main group ion, $1 \leqq n \leqq 8$, $n+m+o \geqq 12$ and $p+q \geqq 4$, or $[V_nMo_mW_o(MG)_pO_r]^{x-}$ where MG is either $P^{5+}$, $As^{5+}$, or $S^{6+}$, $1 \leqq n \leqq 9$, $n+m+o=18$ and p=2.

In the general and preferred formulas mentioned in U.S. Ser. No. 07/937,634 now U.S. Pat. No. 5,302,248, heteroatoms are represented by the symbol "MG" where MG is a main group element However, a number of useful compounds introduced in the present invention contain heteroatoms that are ions of d block, rather than main group, elements. To include these cases, the symbol "X" is used in the present invention to represent a heteroatom that may be either a p (main group) or d block element.

The present invention is also a method of delignifying pulp comprising the steps of obtaining a wood pulp; exposing the wood pulp to a compound of the general formula, wherein the polyoxometalate is reduced; and then oxidizing the reduced polyoxometalate.

Preferably, the reduced polyoxometalate is reoxidized with an oxidant selected from the group consisting of air, oxygen, hydrogen peroxide and other organic or inorganic peroxides (free acid or salt forms), or ozone.

It is an object of the present invention to delignify hardwood or softwood pulp or pulp from other lignocellulosic materials.

It is an additional object of the present invention to delignify wood fibers or other lignocellulosic fibers using a polyoxometalate.

It is an additional object of the present invention to employ an oxidant in the bleaching of pulp that may be regenerated by reoxidation of its reduced form.

It is a feature of the present invention that suitable polyoxometalates may be reoxidized with an oxidant selected from the group consisting of air, oxygen, hydrogen peroxide and other organic or inorganic peroxides (free acid or salt forms), or ozone. These oxidants are more environmentally friendly than chlorine compounds.

It is another feature of the present invention that a polyoxometalate compound may be used as an oxidant in a repeated bleaching sequence.

Other features, objects and advantages of the present invention will become apparent upon examination of the specification, claims and drawings.

DESCRIPTION OF THE FIGURES

FIG. 1A is a Keggin structure, $[XW_{12}O_{40}]^{x-}$ (the charge, x, depends on the heteroatom, X, shown in dark shading in the center of the structure). A transition metal-substituted Keggin anion is obtained when one of the twelve tunsgsten atoms is replaced by a d-electron-containing transition metal ion.

DESCRIPTION OF THE INVENTION

Figure 1A:
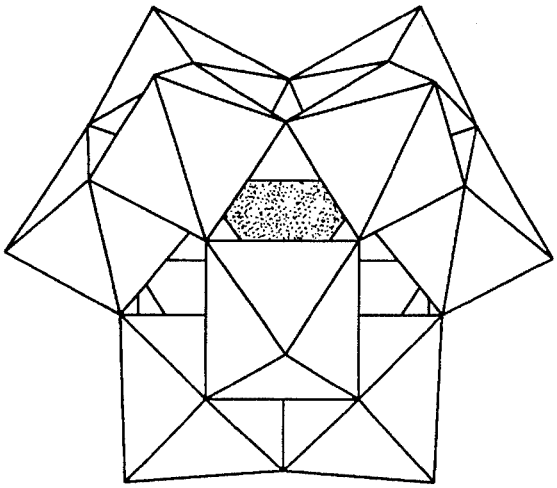
FIGS. 1A, B and C are polyhedral illustrations of three representative polyoxometalates. The light shaded octahedra are $W^{VI}$ ions and each polyhedron vertex is an O atom. Tetrahedral $XO_4$ units, where X is a main group or transition metal ion, are internal to all 3 structures.

The present invention is a method for removing substantial quantities of lignin from pulp. As such, it is an effective alternative to chlorine and plays a similar role in the bleaching of chemical pulps.

In General

The first step in the present invention is the production of a wood pulp. Wood pulps may be produced by any conventional method, including both kraft and non-kraft pulps. Suitable pulp production methods are described in "Pulp and Paper Manufacture," 2nd Edition, Volume I, *The Pulping of Wood,* R. G. Macdonald and J. N. Franklin Eds., McGraw-Hill Book Company, New York, 1969.

Wood pulps are generally divided into softwood pulps (e.g., pine pulps) and hardwood pulps (e.g., aspen pulps). Softwood pulp is the most difficult to delignify because lignin is more abundant in softwoods than in hardwoods. Due to structural differences, largely attributable to the lower average number of methoxy groups per phenyl ring, softwood lignin is less susceptible to oxidative degradation. The Examples below describe the efficiency of the method of the present invention with softwood kraft pulp. However, the present invention is suitable for delignification of hardwood pulps also.

Another class of pulps for which the present invention is suitable is that derived from non-woody plants such as sugar cane, kenaf, esparto grass, and straw, as well as plants producing bast fibers. The lignocellulosic constituents of such plants are usually susceptible to the same pulping methods as are applicable to wood, though in many instances they require less severe conditions than wood. The resulting pulps are usually less difficult to delignify or bleach than are those derived from softwoods by the kraft process.

Polyoxometalate bleaching system

The next step of the present invention is the exposure of the pulp to a polyoxometalate. Polyoxometalates suitable for the present invention may be applied as stoichiometric oxidants, much as chlorine and chlorine dioxide are currently. The general formula of the preferred polyoxometalate is $[V_lMo_mW_nNb_oTa_p(TM)_qX_rO_s]^{x-}$ where l is 0–18, m is 0–40, n is 0–40, o is 0–10, p is 0–10, q is 0–9, r is 0–6, TM is a d-electron-containing transition metal ion, and X is a heteroatom, which is a p or d block element, provided that $l+m+n+o+p \geqq 4$, $l+m+q>0$, and s is sufficiently large that $x>0$. X is typically $Zn^{2+}$, $Co^{2+}$, $B^{3+}$, $Al^{3+}$, $Si^{4+}$, $Ge^{4+}$, $P^{5+}$, $As^{5+}$ or $S^{6+}$.

Preferably, the polyoxometalate used in the present invention is one of five different formulas that are subsets of the general formula:

Formula 1, the transition metal-substituted Keggin structure, is $[V_lMo_mW_n(TM)_oX_pO_q]^{x-}$, where TM is any d-electron-containing transition metal ion, X is a heteroatom, which is a p or d block element, $l+m+n+o=12$, $p=1$, $o \leqq 4$ and $l+m+o>0$. $\alpha$-$K_5[SiMn(III)(H_2O)W_{11}O_{39}]$ (compound 6) is an example of potassium salt of this structure and q is sufficiently large that $x>0$.

Formula 2, the transition metal bridged dimer of the Keggin structure, is $[V_lMo_mW_n(TM)_oX_pO_q]^{x-}$, where TM is any d-electron-containing transition metal ion, X is a heteroatom, which is a p or d block element, $l+m+n+o=22$, l+o is 1–4 and $p=2$.

Formula 3, the transition metal-substituted Wells-Dawson structure, is $[V_lMo_mW_n(TM)_oX_pO_q]^{x-}$, where TM is any d-electron-containing transition metal ion, X is either $P^{5+}$, $As^{5+}$, or $S^{6+}$, $l+m+n+o=18$, $o \leqq 6$, $p=2$ and $l+m+o>0$ and q is sufficiently large that $x>0$.

Formula 4, the transition metal bridged dimer of the tri-vacant Wells-Dawson structure, is $[Mo_mW_n(TM)_4X_pO_q]^{x-}$, where TM is any d-electron-containing transition metal ion, X is either $P^{5+}$, $As^{5+}$ or $S^{6+}$, $m+n=30$ and $p=4$ and q is sufficiently large that $x>0$.

Formula 5, the transition metal-substituted Preyssler structure, is $[V_lMo_mW_n(TM)_oP_5C_pNa_qO_r]^{x-}$, where TM is any d-electron-containing transition metal ion, C is a di- or tri-valent main group, transition metal or lanthanide cation located in the center of the structure, $l+m+n+o=30$, $p+q=1$ and $l+m+o>0$ and r is sufficiently large that $x>0$.

The following formulas for vanadium-containing polyoxometalates (Formulas 6–8) were disclosed in U.S. Ser. No. 07/939,634 as suitable for the pulping method. The formulas are all subsets of the general formula and are also preferred for the methods of the present invention. More specifically, Formulas 7 and 8 are subsets, respectively, of Formulas 1 and 3.

Formula 6, an isopolyvanadate, is $[V_nO_r]^{x-}$, where $n \geqq 4$, $r \geqq 12$ and $x=2r-5n$. $Na_6[V_{10}O_{28}]$, compound 4 in the Examples below, is an example of a sodium salt of a polyoxometalate of this formula.

Formula 7, the Keggin structure, is $[V_nMo_mW_o(MG)_p(TM)_qO_r]^{x-}$, where TM is any transition metal, MG is a main group ion, $1 \leqq n \leqq 8$, $n+m+o \leqq 12$ and $p+q \leqq 4$. $H_5[PV_2Mo_{10}O_{40}]$, compound 1, is an example of an acid of this formula. $Na_4[PVW_{11}O_{40}]$, compound 2, is an example of a sodium salt.

Formula 8, the Wells-Dawson structure, is $[V_nMo_mW_o(MG)_pO_r]^{x-}$ where MG is either $P^{5+}$, $As^{5+}$, or $S^{6+}$, $1 \leqq n \leqq 9$, $n+m+o=18$, and $p=2$. $H_9[P_2V_3W_{15}O_{62}]$, compound 3, is an example of an acid of this structure.

A common feature of the structures described in the formulas above is the presence of a vanadium ion in its +5 $d^0$ electronic configuration, of a molybdenum ion in its +6 $d^0$ electronic configuration or of a d-electron-containing transition metal ion capable of reversible oxidation and that in one of its oxidation states is sufficiently active so as to oxidatively degrade lignin. In combination with chlorine-free oxidants such as oxygen, peroxides or ozone, complexes of this type oxidize functional groups within lignin, leading to delignification and bleaching. This can occur via direct lignin oxidation by the d-electron-containing transition metal ion, or by a vanadium(+5) or molybdenum(+6) ion, leading to reversible reduction of the transition metal, vanadium, or molybdenum ion. In a subsequent step, the reduced polyoxometalate bleaching agent is regenerated to its active form by reaction with the chlorine-free oxidant. Alternatively, the polyoxometalate complex can react with pulp in the,presence of the chlorine-free oxidant. In either case, it is essential that a d-electron-containing transition metal, vanadium(+5), or molybdenum(+6) ion be present in the polyoxometalate structure. The structures defined by the above formulas are all logical candidates for use in bleaching with chlorine-free oxidants because they all possess either d-electron-containing transition metal, vanadium(+5) or molybdenum(+6) ions.

Compounds 1, 2 and 6, all compounds of Formula 1, were chosen for the Examples given below because they are some of the most thoroughly studied polyoxometalates and some of the simplest to prepare (compound 1, Kozhevnikov, I. V., et al. *Russian Chemical Reviews,* 51:1075–1088, 1982; compound 2, Kuznetsova, L. I., et al., *Inorganica Chimica Acta,* 167, 223–231, 1990; compound 6, Tourné, C. M., et al. *Journal of Inorganic and Nuclear Chemistry,* 32:3875–3890, 1970).

Formula 2 describes dimeric derivatives of compounds of Formula 1 (Finke, R. G., et al., *Inorganic Chemistry,* 26:3886–3896, 1987; Khenkin, A. M., .et al., in The Activation of Dioxygen and Homogeneous Catalytic Oxidation, Barton, D. H. R., ed., Plenum Press, New York, 1993, 463; Gómez-García, C. J., et al., *Inorganic Chemistry,* 32:3378–3381, 1993; Tourné, G. F., et. al., *J. Chem. Soc., Dalton Trans.* 1991, 143–155). Some of these derivatives, whether vanadium(+5) or d-electron-containing transition metal-substituted, are particularly well-suited for use in bleaching because they exhibit remarkably high selectivities and possess extremely high stabilities.

Compounds of Formula 3 are structurally closely analogous to those of Formula 1, very similar in reactivity, and significantly more stable (Lyon, D. K., et al., *Journal of the*

*American Chemical Society,* 113:7209–7221, 1991). Compound 3 is a vanadium derivative of a structure of Formula 3 (Finke, R. G., et al, *J. Am. Chem. Soc.,* 108:2947–2960, 1986). Compounds of Formula 4 are dimeric derivatives of those defined by Formula 3 (Finke, R. G., et al., *Inorganic Chemistry,* 26:3886–3896, 1987; Khenkin, A. M., et al., in The Activation of Dioxygen and Homogeneous Catalytic Oxidation, Barton, D. H. R., ed., Plenum Press, New York, 1993, 463).

In the case of Formula 5, a number of main group-ion and lanthanide-ion derivatives, and one vanadium-ion-substituted structure, have been prepared and characterized (Creaser, I., et al., *Inorganic Chemistry,* 32:1573–1578, 1993). The vanadium-substituted structure contains vanadium(+5) in place of one of the structural tungsten atoms. Based on the reported oxidation potential of this vanadium-substituted polyoxometalate, this compound would clearly be useful in delignification and bleaching (Alizadeh, et al., *J. Am. Chem. Soc., 107:2662–2669, 1985*). By analogy with the well-established syntheses of structures of Formulas 1 and 3, it is logical that, in addition to vanadium(+5), molybdenum(+6) or d-electron-containing transition metal ions could also be substituted in place of a structural tungsten atom. Based on the criteria outlined immediately following the introduction of Formulas 1–8 above, these complexes would be effective in bleaching. Such derivatives of Formula 5 are likely to be extremely stable and thus particularly useful for commercial applications.

Figure 1C:
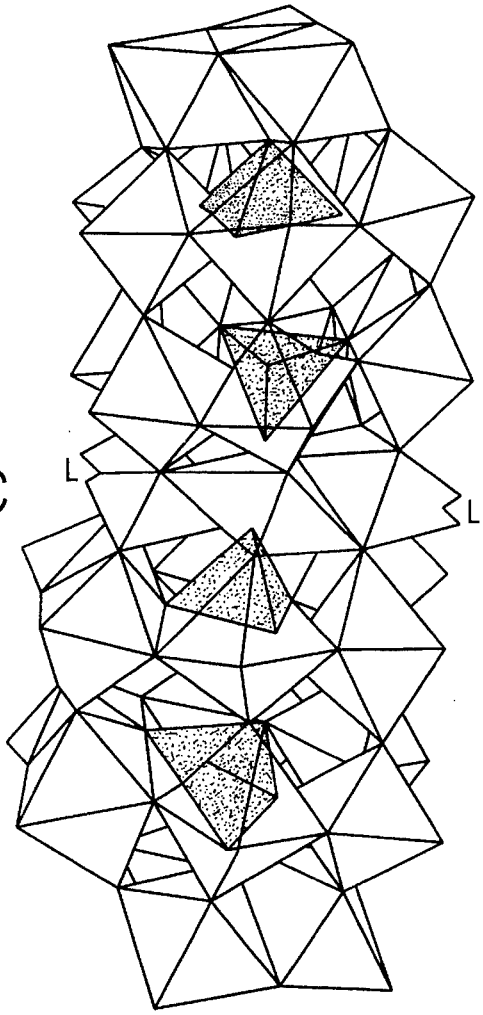
FIG. 1C is a trivacant Wells-Dawson derived sandwich complex $[(M^{II})_2(M^{II}L)_2(P_2W_{15}O_{56})_2]^{16-}$, where M represent d-electron-containing transition metal ions (dark shaded octahedra) and L is an exchangeable ligand.
Figure 1B:
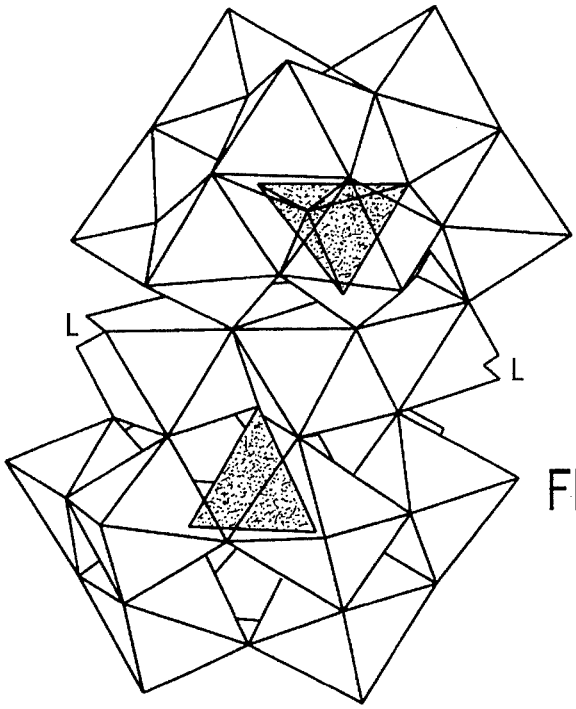
FIG. 1B is a trivacant Keggin derived sandwich complex, $[(M^{II})_2(M^{II}L)_2(PW_9O_{34})_2]^{10-}$

FIG. 1. is a polyhedral illustration of three representative polyoxometalates of the formulas $[XW_{12}O_{40}]^{x-}$, $[(M^{II})_2(M^{II}L)_2(PW_9O_{34})_2]^{10-}$, and $[(M^{II})_2(M^{II}L)_2(P_2W_{15}O_{56})_2]^{16-}$.

Polyoxometalate salts are generally water soluble (hydrophilic). However, hydrophobic forms can be made easily and are suitable for use in selective bleaching with solvents other than water. Some cations suitable for formation of hydrophobic forms are defined in U.S. Pat. No. 4,864,041 (inventor: Craig L. Hill).

The polyoxometalate of the present invention is typically in an acid, salt or acid-salt form. For example, compounds 5 and 6 are in salt form. Suitable cations for salt formation are $Li^+$, $Na^+$, $K^+$, $Cs^+$, $NH_4^+$ and $(CH_3)_4N^+$ which may be replaced in part (acid-salt form) or in full (acid form) by protons ($H^+$). Compounds 1 and 3 are in acid form, compounds 2 and 4 have sodium counter ions, and compounds 5 and 6 have potassium counter ions. The listed cations are sensible choices, but there are others that are available and cost-effective.

An attractive feature of polyoxometalates is that they are reversible oxidants and, thus, could function as mediating elements in a closed-loop bleaching system in which used polyoxometalate solutions are regenerated by treatment with chlorine-free oxidants.

Accordingly, the present invention involves the step of oxidative degradation of residual lignin by the polyoxometalates. Another embodiment of the present invention additionally has the step of regeneration of the polyoxometalates with chlorine-free oxidants. In the first step (eq. 1), mixtures of water, pulp and a fully oxidized polyoxometalate ($P_{ox}$), are heated. During the reaction, the polyoxometalate is reduced as the lignin-derived material within the pulp is oxidized. The reduced polyoxometalate ($P_{red}$) must be reoxidized before it can be used again. This is done by treating the polyoxometalate solution with chlorine-free oxidants such as air, oxygen, hydrogen peroxide and other organic or inorganic peroxides (free acid or salt forms), or ozone (eq. 2). Alternatively, reoxidation (eq. 2) could be performed at the same time as reduction (eq. 1), thus omitting the necessity for two separate steps.

$$\text{Pulp}+P_{ox}\rightarrow\text{Bleached Pulp}+P_{red} \quad (1)$$

$$P_{red}+O_2+4H^+\rightarrow P_{ox}+2H_2O \quad (2)$$

In addition to equations (1) and (2), a foreseeably useful method for using polyoxometalates as catalytic agents in delignification and bleaching would be to introduce a chemically-derived mediating agent. Such an agent would be chosen for its ability to selectively transfer electrons from specific functional groups in the lignin polymer to the polyoxometalate. For example, a thiol derivative mediating agent could be used, but many others are available and potentially useful. Thiols, for example, are known to react with polyoxometalates under mild conditions, reducing the polyoxometalate and generating thiyl radicals. Thiyl radicals are known to selectively oxidize lignin at benzylic positions, a reaction known to result in fragmentation of lignin model compounds (Wariishi, et al., *J. Biol. Chem.,* 264:14185–14191, 1989). Such an improvement on the present invention might make the process more economical by allowing for significant reductions in the amount of polyoxometalate required for bleaching, and by allowing for simultaneous use of dioxygen and polyoxometalate under conditions mild enough to more easily avoid oxygen-radical degradation of cellulose fibers.

As described below in the Examples, aqueous polyoxometalate solutions, preferably 0.001 to 0.20M, are prepared and the pH adjusted to 1.5 or higher. The polyoxometalate may be prepared as in references given in the Examples or by other standard procedures. An organic or inorganic buffer may be added to maintain the pH within a desired range during the bleaching reaction. Pulp is added to the polyoxometalate solution to a preferable consistency of approximately 1–12%, although consistencies up to 20% may be useful. The mixture is heated in a sealed vessel either in the presence or absence of oxygen or other oxidants (M stage). The temperature and duration of polyoxometalate treatment will depend upon other variables, such as the nature of the pulp, the pH of the polyoxometalate solution and the nature and concentration of the polyoxometalate.

The bleaching of chemical pulps entails two interrelated phenomena: delignification and whitening. Once a significant amount of residual kraft lignin has been removed from a kraft pulp, the pulp becomes relatively easy to whiten by a number of means, including additional polyoxometalate treatment or treatment with hydrogen peroxide or other inorganic or organic peroxides. In the Examples given below, the effectiveness of the polyoxometalates in bleaching is demonstrated by their ability to delignify unbleached kraft pulp. It is understood, however, that to meet the requirements of specific grades of market pulp, additional polyoxometalate or other oxidative treatment, such as reaction with alkaline hydrogen peroxide, might be employed to achieve final pulp whitening.

To oxidize the reduced polyoxometalate, the polyoxometalate solution may be collected after the reaction is complete, and reoxidized. The oxidant is preferably air, oxygen, peroxide, or ozone.

The pulps are washed with water and may be extracted for 1–3 hours at 60°–85° C. in 1.0% NaOH (E stage). The cycle may be repeated in a MEME or VEVE sequence, and may be followed by an alkaline hydrogen peroxide (P) stage. For the P stage, typically 30% aqueous hydrogen peroxide is added to a mixture of pulp and dilute alkali to give a final pH of approximately 9–11 and a consistency of 1–12%. The mixture is then heated for 1–2 hours at 60°–85° C. The quantity of hydrogen peroxide, defined as weight percent relative to the O.D. (oven dried) weight of the pulp may vary from 0.5–40%.

In the bleaching of chemical pulps, the polyoxometalates react with lignin to solubilize it and to render it more susceptible to extraction with hot alkali. Since many pulping processes, including the kraft process, require cooking wood chips in hot alkali, we envision that polyoxometalates will be useful in commercial pulping because of the role that polyoxometalates play in the bleaching of kraft pulp. Thus, the present invention includes treating wood chips or wood meal with polyoxometalates under conditions analogous to those used in the M stage of the bleaching process, and then pulping the wood chips or meal under alkaline conditions. The result is that greater reductions in lignin content are then found in polyoxometalate treated wood, than in wood pulped under the same conditions, but with no polyoxometalate pre-treatment.

EXAMPLES

Bleaching of chemical pulps.

Vanadium(+5) and d-electron-containing transition metal-substituted polyoxometalates representing several structural classes were evaluated. The complexes evaluated were as follows: a phosphomolybdovanadate, $H_5[PV_2Mo_{10}O_{40}]$ (compound 1, Formula 7, a subset of Formula 1) (Kozhevnikov, I. V., et al. *Russian Chemical Reviews,* 51:1075–1088, 1982); the phosphotungstovanadates $Na_4[PVW_{11}O_{40}]$ (compound 2, Formula 7, a subset of Formula 1) (Kuznetsova, L. I., et al., *Inorganica Chimica Acta* 167:223–231, 1990) and $H_9[P_2V_3W_{15}O_{62}]$ (compound 3, Formula 8, a subset of Formula 3) (Finke, R. G., et al, *J. Am. Chem. Soc.* 108:2947–2960, 1986); and the well-known isopolyvanadate, $Na_6[V_{10}O_{28}]$ (compound 4, Formula 6).

We also evaluated a manganese-substituted tungstosilicate, $\alpha$-$K_6[SiMn(II)(H_2O)W_{11}O_{39}]$ (compound 5, Formula 1) (Tourné, C. M., et al. *J. of Inorganic and Nuclear Chemistry,* 32:3875–3890, 1970). For activity in anaerobic bleaching, compound 5 must first be oxidized to $\alpha$-$K_5[SiMn(III)(H_2O)W_{11}O_{39}]$ (compound 6, Formula 1) by one electron oxidation at the manganese ion.

To demonstrate the effectiveness of the d-electron containing-transition metal-substituted polyoxometalate, the amount of residual lignin remaining after the polyoxometalate treatment, and after subsequent alkaline extraction, was monitored. The results, reported in Examples 6 and 10(c), are superior to those reported in U.S. Ser. No. 07/937,634 now U.S. Pat. No. 5,302,248.

General method.

Bleaching experiments were carried out as follows: Aqueous polyoxometalate solutions, 0.01 to 0.20M, were prepared. The pH of each solution was adjusted to 1.5–5.0. Mixed pine kraft pulp (kappa number=33.6) was then added to the polyoxometalate solution to a consistency of approximately 3.0% and the mixtures heated at 100 to 125° C. for one to four hours in a sealed vessel. When a vanadium-containing polyoxometalate is used, we call this the "V stage." When a non-vanadium polyoxometalate is used, we call this the "M stage." In some cases the reactions were run anaerobically, under nitrogen. Control experiments were carried out using identical conditions in parallel sequences, but with no added polyoxometalates. We call the control version of the M or V stage, in which no polyoxometalate was added, the Delta ($\Delta$) stage. Sequential M stages are designated $M_1$, $M_2$ and $M_3$. Sequential control stages are designated $\Delta_1$, $\Delta_2$ and $\Delta_3$.

After completion of the M/V or $\Delta$ stages, the pulps were extracted with alkali. The alkaline extraction step is designated E.

After exposure to the pulp, the polyoxometalate solutions were collected by filtration. The polyoxometalate solutions were then reoxidized with air, oxygen, hydrogen peroxide and other organic or inorganic peroxides (free acid or salt forms), or ozone.

The pulps were washed with water and extracted for one to three hours at 60°–85° C. in 1.0% NaOH (E stage). In one case, this cycle was repeated in a VEVE sequence, followed by an alkaline hydrogen peroxide (P) stage.

After each stage, the pulps were analyzed for lignin content both spectroscopically (UV-vis and FT Raman spectroscopy) and chemically (kappa numbers). Fiber quality was monitored by measuring the intrinsic viscosities of pulp solutions according to TAPPI methods. Technodyne brightnesses were obtained according to TAPPI methods.

Reoxidation of the reduced vanadium-substituted polyoxometalates by air, hydrogen peroxide, peroxyacids and ozone was monitored by UV-vis spectroscopy, and the integrity of the material in the reoxidized vanadium-substituted polyoxometalate solutions was confirmed by $^{31}P$ NMR spectroscopy.

Oxidation of a variety of d-electron-containing transition metal-substituted polyoxometalate complexes to their active oxidized forms can be accomplished using air, hydrogen peroxide or other peroxides (Tourné, C. M., et al. *J. of Inorganic and Nuclear Chemistry,* 32:3875–3890, 1970). The formation of active (oxidized) polyoxometalates can be monitored spectroscopically and titrametrically. In the case of compound 5, oxidation to compound 6 was accomplished with ozone, and its formation was monitored using UV-vis and FTIR spectroscopy, and by titration.

Kappa numbers.

Kappa numbers, obtained by permanganate oxidation of residual lignin, are an index of how much lignin is present within a wood or pulp sample. Although difficult to measure accurately or to interpret when only small amounts of lignin are present, kappa numbers are a widely used and easily recognized index of lignin content. For relatively small pulp samples, microkappa numbers are determined. Microkappa numbers were obtained using TAPPI methods T236 om-85 and um-246. In the Examples, microkappa numbers were determined for each polyoxometalate treated pulp sample and for appropriate controls. The microkappa number determined for the unbleached kraft pulp used in the Example below was 33.6. Microkappa number determinations are used in Examples 1–3 and 6 below to demonstrate that lignin-like material is effectively degraded or otherwise removed from the pulp during polyoxometalate bleaching.

UV-vis spectroscopy.

Two spectroscopic techniques, transmission UV-vis spectroscopy and FT Raman spectroscopy, were used to monitor the removal of lignin-derived material from the chemical pulp upon treatment with the polyoxometalates.

UV-vis spectra of the pulp samples exposed to the four different polyoxometalate compounds were obtained after each stage V, VE and VEP and after the control sequences $\Delta$, $\Delta$E and $\Delta$EP. For each spectrum, approximately 10 mg of oven dried pulp was dissolved slowly in 85% phosphoric acid at room temperature. UV-vis spectra of the resultant solutions were obtained using a Perkin Elmer Lambda 6 spectrophotometer, and displayed as plots of extinction coefficients (E in units of L/g-cm) vs wavelengths (Lambda), from 600 to 190 nm. Since cellulose is transparent over this frequency range, we attribute the observed absorption to conjugated structures associated with residual lignin. Thus, as residual lignin is removed from the pulp the area under the curve decreases. The spectra are displayed as comparisons of polyoxometalate treated pulps and control pulps at specified stages of the bleaching sequence. Sets of spectra obtained for bleaching Examples 1, 4 and 5 are presented in FIGS. 2–4.

FT Raman spectroscopy.

A published spectroscopic method (Weinstock, et al., Proceedings of the 1993 TAPPI Pulping Conference; 1993 November 1–3; Atlanta, Ga., 519–532.), using FT Raman spectroscopy, was used to monitor the oxidative degradation of residual lignin.

FT Raman spectra of pulp samples were recorded using an RFS 100 $Nd^{3+}$:YAG laser (1064 nm excitation) instrument, using a 180° reflective sample geometry. The bands observed in the FT Raman spectra of lignocellulosic materials correspond to both lignin and carbohydrate components of the pulp. Lignin content was calculated by measuring changes in the 1595 $cm^{-1}$ band (1671–1545 $cm^{-1}$), associated with one of the symmetric ring stretching modes of phenyl groups present in the residual lignin. The intensity of this band correlates well with the amount of residual lignin in the sample. Spectra acquired in all but the later stages of the process included substantial fluorescent backgrounds. Thus, for quantitative comparison, band areas were calculated as the peak above the baseline created by the fluorescence. For quantification, the band of interest must be compared to one that remains constant throughout the bleaching process. The cellulose band structure between 1216–1010 $cm^{-1}$ was chosen for this purpose. Using these bands, changes in lignin content were quantified by measuring the ratios of integrated areas of the 1595 $cm^{-1}$ bands against those of the band structure between 1216–1010 $cm^{-1}$. In Example 6, FT Raman spectroscopy is used to demonstrate that phenyl groups, representing lignin, are effectively degraded or otherwise removed from the pulp during polyoxometalate bleaching.

Selectivity and Pulp Viscosity.

The intrinsic viscosity ($\eta$) of a pulp sample is proportional to the average chain length of cellulose polymers within the pulp fibers. Consequently, retention of pulp viscosity during bleaching is one of several criteria indicating that cellulose fibers have not been cleaved or degraded during bleaching. In this regard, the relative rate of reaction of a bleaching agent with lignin vs. its rate of cleavage or degradation of cellulose fibers is referred to as the Selectivity of the agent. Bleaching agents highly selective for lignin are necessary for the commercial production of pulps that meet market specifications. In Example 10(c) below, it is demonstrated that d-electron-containing transition metal-substituted polyoxometalates are highly selective for lignin in bleaching.

Before bleaching, the mixed-pine kraft pulp used in the Examples below had an intrinsic viscosity (in solution with cupric sulfate and ethylene diamine according to TAPPI test method T230 om-89) of 34.2 mPa.s.

EXAMPLE 1

$H_5[PV_2Mo_{10}O_{40}]$ (Compound 1)

VEP Sequence.

2.0 g oven-dried (O.D.) weight of mixed pine kraft pulp was added to a 0.100M solution of compound 1, adjusted to a pH of 1.45 by addition of 1N NaOH, to a final consistency of 3.0% in a 100 mL round-bottomed flask. The pH of the mixture was 1.54. The flask was sealed in air and heated in a 100° C. bath for four hours. During heating, the solution changed from orange to dark green-brown.

The pulp, now somewhat darker and slightly reddish-brown in color, was collected on a Buchner funnel and the partially reduced polyoxometalate solution (pH=1.98) was saved.

The partially reduced polyoxometalate solution was titrated to an orange endpoint with ceric ammonium sulfate. 3.2% of the vanadium(V) present, or $2.07\times10^{-4}$ mol of V(V) per 1.0 g O.D. pulp, had been reduced to vanadium(IV). (The oxidation states of metal ions may be designated by Roman as well as by Aramaic numerals. Thus, vanadium(V) is equivalent to vanadium(+5)).

The pulp was washed three times with water and heated for three hours at 85° C. in 1.0% aqueous NaOH at a consistency of 3.2% in an open round-bottomed flask. At the end of this time the alkali solution was brown, and the pulp had lost some of its dark reddish color. After collecting and washing the pulp with water, a portion was treated with 40% $H_2O_2$, relative to the O.D. weight of the pulp, at a consistency of 2.0% for 1.5 hours at 85° C. and an initial pH of 10.42.

A control experiment was performed in parallel under identical conditions, but without added polyoxometalates. In the control, no darkening of the pulp occurred in the first stage ($\Delta$) and little color was observed in the aqueous NaOH solution after the E stage.

Prior to reuse of the polyoxometalate solution, air was bubbled gently through the polyoxometalate solution for 1.5 hours at 60° C., and the pH of the solution was then adjusted to 1.5 with concentrated $H_2SO_4$. The reoxidation was monitored spectrophotometrically. After reoxidation, the $^{31}P$ NMR spectrum of the reoxidized polyoxometalate solution was obtained. No phosphorus-containing decomposition products were observed.

Table 1 describes kappa number and brightness measurements for the V, E and P stages of Example 1. The kappa number, indicating the amount of lignin present, is lower in the V E measurements as opposed to the $\Delta$ and $\Delta$E measurements. Significant delignification is evident after the E stage in the polyoxometalate treated pulp, while brightening does not occur until the P stage.

An asterisk in Table 1 or any of the following tables indicates that a value is too low to be determined accurately.

TABLE 1

| | Kappa No. | Brightness |
|---|---|---|
| V | 19.2 | 19.1 |
| E | 10.7 | 26.7 |
| P | (1.7)* | 71.2 |
| $\Delta$ | 24.7 | 31.7 |
| E | 18.9 | 33.5 |
| P | 7.2 | 55.9 |

To determine the viscosity of the pulp after the V and $\Delta$ stages, compound 1 was used as described above, but with careful exclusion of oxygen during the V stage. Pulp viscosities, measured after V and $\Delta$, and after VE and $\Delta$E are tabulated below in Table 2.

In the present invention, the efficacy of the polyoxometalate compounds 1–4, was demonstrated at low pH values of 1.5 to 2.5. After heating at these pH values for four hours at 100° C., substantial acid-catalyzed degradation of the cellulose fibers occurs. As a result of the low pHs used in the examples, pulp viscosities are all lower than they would have been if the reactions were done at higher pH values. Many polyoxometalates are stable at higher pH values. For example, compound 3 is stable when heated for four hours at 100° C. at a pH of 4 (I. A. Weinstock, unpublished results) and materials closely related to compound 2, e.g., $Na_xH_{6-x}[PW_9V_3O_{40}]$, are stable at pH values as high as 8 (Kuznetsova, L. I., et al., *Inorganica Chimica Acta,* 167:223–231, 1990). However, the stability of compound 1 at higher pH values has not been firmly established. In order to demonstrate the efficacy of compounds 1–4, as bleaching agents, as quickly as possible, we chose a low pH at which all of the materials are stable at elevated temperatures.

Therefore, although the viscosities reported here are low, the relatively small differences between the polyoxometalate-treated pulps and the control pulps heated at the same pH, but with no added polyoxometalates suggest that when run at higher pH values, the polyoxometalate-treated pulps should meet industry standards. This has since been demonstrated at pH 7 using a vanadium-substituted polyoxometalate of Formula 1 that is closely related to compounds of Formulas 3, 5, 7 and 8 (Weinstock, et al., Proceedings of the 1993 TAPPI Pulping Conference; 1993 November 1–3; Atlanta, Ga., 519–532) and the d-electron-containing transition metal-substituted polyoxometalate, compound 6, used in Examples 6 and 10(c) below.

TABLE 2

| | η | |
|---|---|---|
| V | 6.52 | |
| E | 6.58 | |
| Δ | 11.04 | η (Δ − V) = 4.52 |
| E | 12.03 | η (Δ − V) = 5.45 |

Figure 2A:
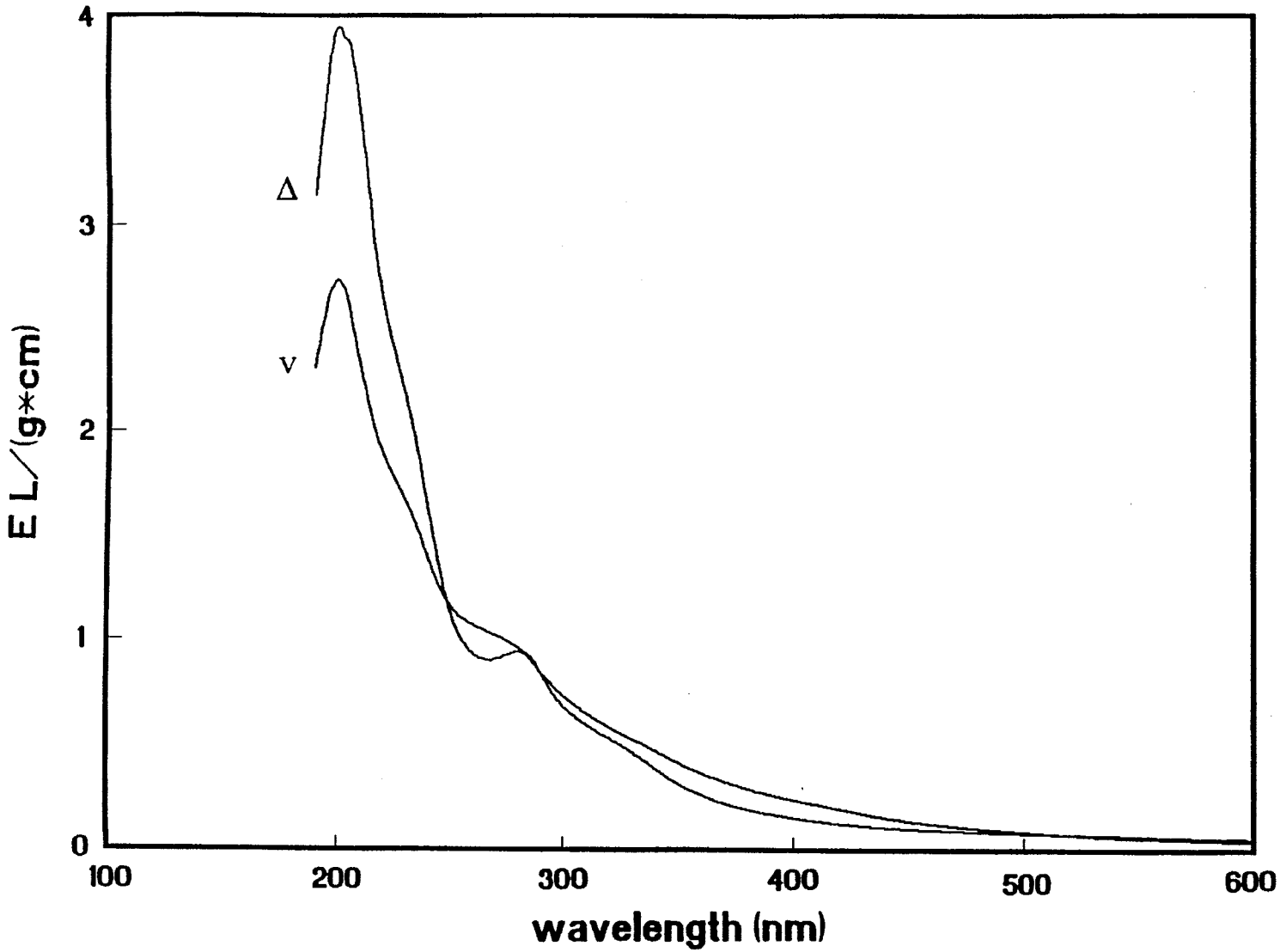
FIG. 2*a* is a plot of E vs Lambda for pulps obtained after stages V and Δ in Example 1.
Figure 2B:
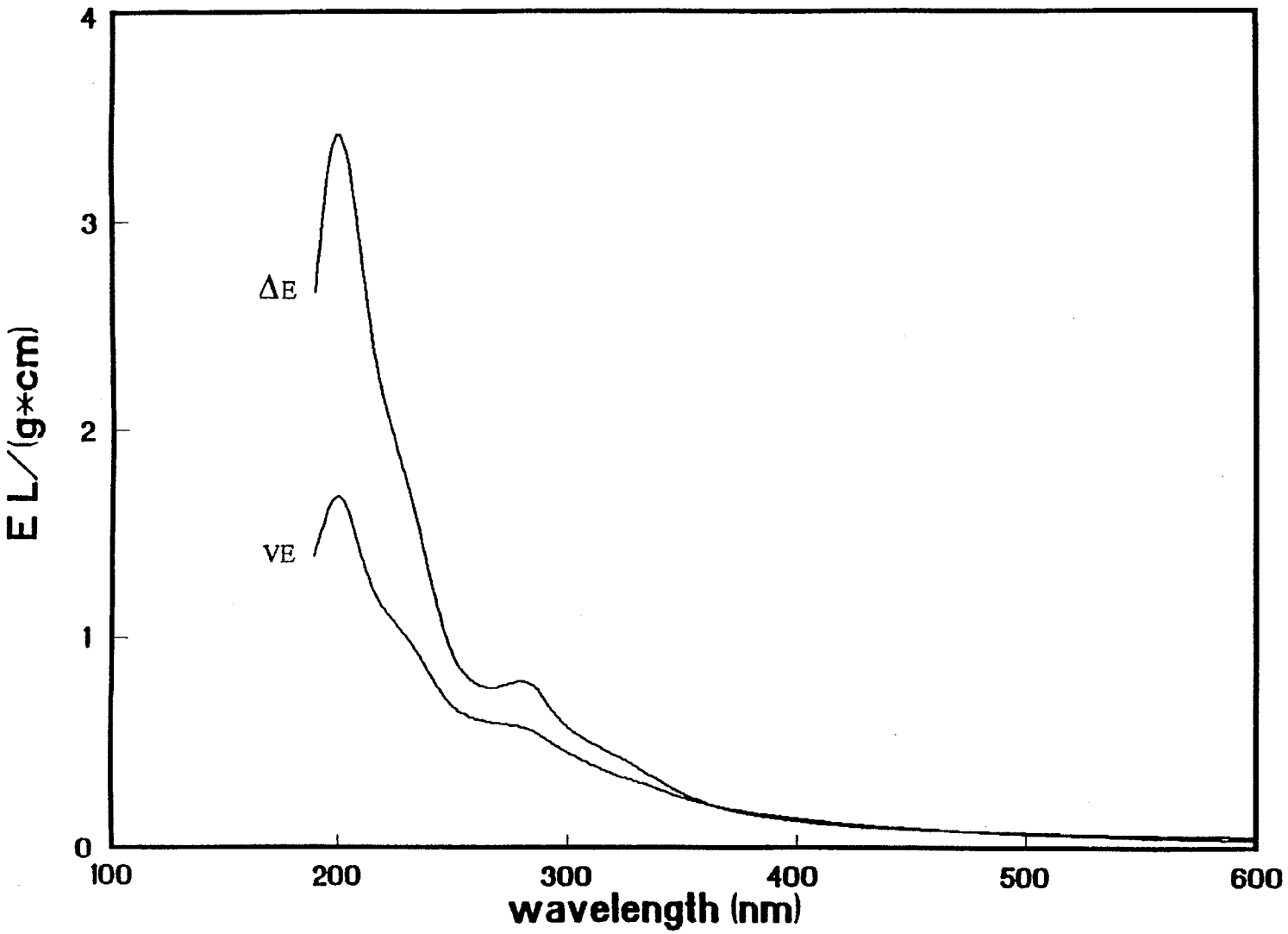
FIG. 2*b* is a plot of E vs Lambda for pulps obtained after stages VE and ΔE in Example 1.
Figure 2C:
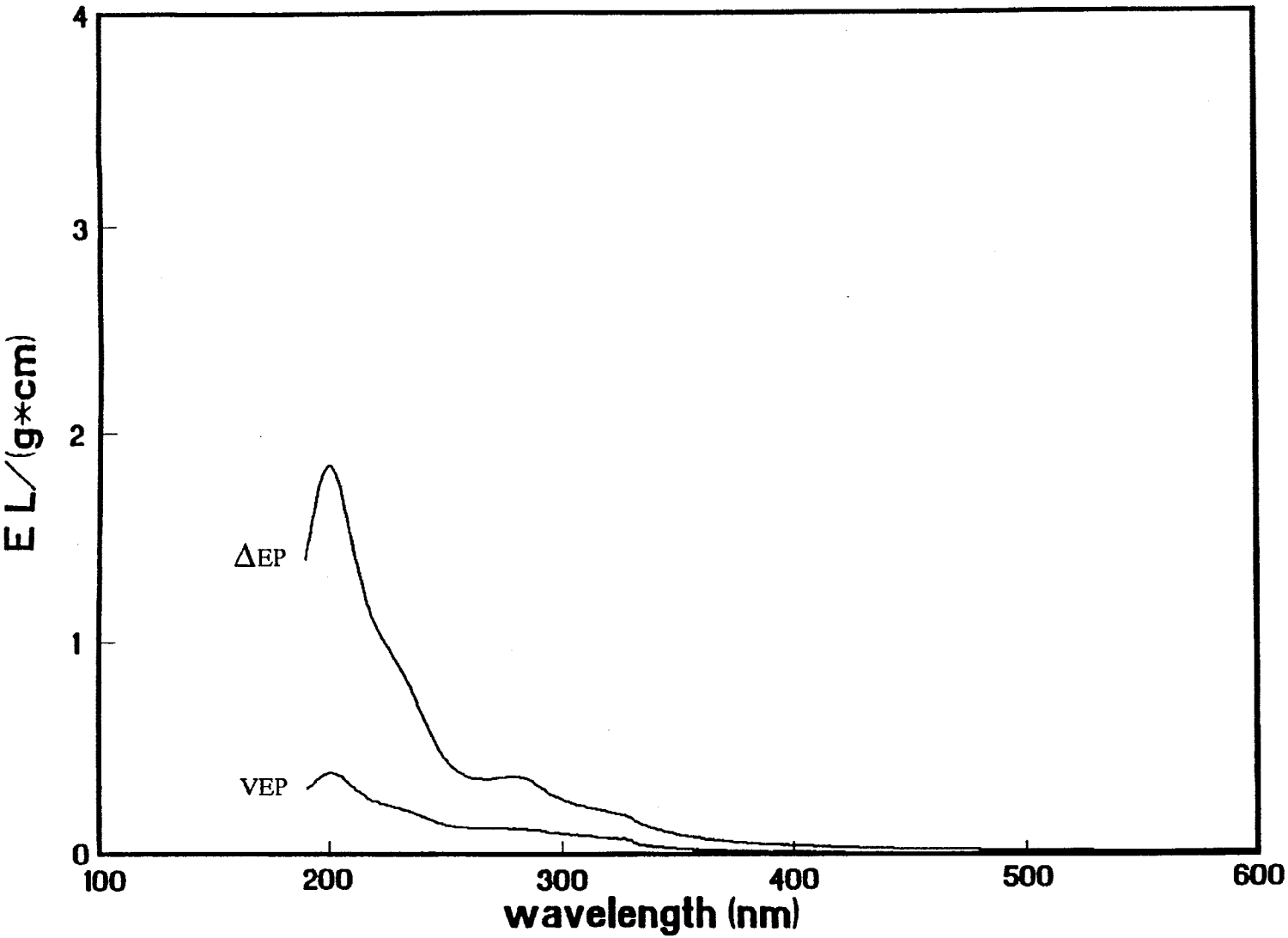
FIG. 2*c* is a plot of E versus Lambda for pulps obtained after stages VEP and ΔEP in Example 1.

FIGS. 2*a*, 2*b* and 2*c* illustrate spectrophotometric differences in pulps treated with compound 1. FIG. 2*a* is a plot of E versus Lambda for pulps obtained after stages V and Δ. FIG. 2*b* is a plot of E versus Lambda for pulps obtained after stages VE and ΔE. FIG. 2*c* is a plot of E versus Lambda for VEP and ΔEP pulps. The P stage involved 40% $H_2O_2$ per O.D. pulp.

FIGS. 2*a–c* indicate that there is less lignin present after the V stage than after the Δ stage and that there is less lignin present after the VE and VEP stages than after the ΔE and ΔEP stages.

EXAMPLE 2

$H_5[PV_2Mo_{10}O_{40}]$ (Compound 1)

VEVEP Sequence.

Compound 1 was used in a $V_1EV_2EP$ sequence, with a control sequence denoted ΔEΔEP. In the first stage, $V_1$, 5.0 g O.D. weight of mixed pine kraft pulp was added to a 0.100M solution of compound 1 to a final consistency of 3.0% in a 500 mL round-bottomed flask. The pH of the mixture was 1.52. The flask was sealed in air and heated in a 100° C. bath for four hours.

At the end of the reaction, the pH of the solution was 1.70 and 3.13% of the vanadium(V) present, or $2.03\times10^{-4}$ mol of V(V) per 1.0 g O.D. pulp, had been reduced. Extractions were carried out in 1.0% NaOH as described above. After the second V stage, $V_2$ (1.0 g oven dried weight of the $V_1E$ treated pulp at a consistency of 1.0% in a 0.03M solution of compound 1 at a pH of 1.50), $4.38\times10^{-5}$ mol of V(V) per 1.0 g O.D. pulp were reduced. After a second extraction stage, the pulp was treated with 10% $H_2O_2$, relative to the O.D. weight of the pulp, at a consistency of 2.0% for 1.5 hours at 85° C. and an initial pH of 11.19. The control sequence, ΔEΔEP, was carried out in parallel with no added polyoxometalates.

Table 3 describes the kappa number and brightness measurements for the different stages in the above-described experiment. Kappa numbers are less at every stage of the polyoxometalate-exposed pulp than the control pulp. In particular, the effect of repeating the VE sequence is shown by the large differences in kappa numbers measured after VEVE and ΔEΔE. Note that, due to repetition of VE, only 10% $H_2O_2$ per O.D. pulp is needed to dramatically improve the brightness of the polyoxometalate treated pulp relative to that of the control.

TABLE 3

| | Kappa No. | Brightness |
|---|---|---|
| V | 19.2 | 19.1 |
| E | 10.7 | 26.7 |
| V | — | — |
| E | 5.2 | — |
| P | (1.4)* | 68.3 |
| Δ | 24.7 | 31.7 |
| E | 18.9 | 33.5 |
| Δ | — | — |
| E | 17.1 | — |
| P | 9.9 | 50.0 |

EXAMPLE 3

$Na_4[PVW_{11}O_{40}]$ (Compound 2)

VEP Sequence 1.0 g O.D. weight of mixed pine kraft pulp was added to a 0.09M solution of compound 2 to a final consistency of 3.0% in a 100 mL round-bottomed flask. The pH of the mixture was adjusted to 1.50 with concentrated $H_2SO_4$. The flask was sealed in air and heated in a 100° C. bath for four hours. During heating, the solution changed from orange to greenish-brown. The pulp, now somewhat lighter in color, was collected on a Buchner funnel and the partially reduced polyoxometalate solution (pH=1.67) was saved. 43.6% of the vanadium(V) present, or $1.27\times10^{-3}$ mol V(V) per 1.0 g O.D. pulp, had been reduced to vanadium(IV).

The pulp was washed three times with water and heated for three hours at 85° C. in 1.0% aqueous NaOH at a consistency of 3.2% in an open round-bottomed flask. At the end of this time the alkali solution was brown, and the pulp was lighter in color. After collecting and washing the pulp with water, a portion was treated with 40% $H_2O_2$, relative to the O.D. weight of the pulp, at a consistency of 2.0% for 1.5 hours at 85° C. and an initial pH of 10.48.

The reduced polyoxometalates in the solution of compound 2 were reoxidized by addition of oxone (potassium monopersulfate compound) (30 mg/per mL solution) and heating to 100° C. for 10 minutes. The reoxidation was monitored spectrophotometrically and the $^{31}P$ NMR spectrum of the reoxidized polyoxometalate solution was obtained (see Example 8). No phosphorus-containing decomposition products were observed.

Table 4 describes the kappa number and brightness measurements for the different stages of the above-described experiment. Notably, the kappa number after VE is dramatically lower than that after ΔE and is too low to measure accurately after the P stage in the VEP sequence. Once again, the brightness measurement indicates that the polyoxometalate treated pulp is easier to brighten than the control pulp.

TABLE 4

| | Kappa No. | Brightness |
|---|---|---|
| V | — | — |
| E | 7.6 | — |
| P | * | 67.8 |
| Δ | 24.7 | 31.7 |
| E | 18.9 | 33.5 |
| P | 7.2 | 55.9 |

EXAMPLE 4

$H_9[P_2V_3W_{15}O_{62}]$ (Compound 3)

VE Sequence.

0.10 g O.D. weight of mixed pine Kraft pulp was added to a 0.10M solution of compound 3 to a final consistency of 2.7% in a 15 mL round-bottomed flask. The pH of the mixture was adjusted to 1.50 with concentrated $H_2SO_4$. Air was removed in three freeze-pump-thaw cycles, and the flask was sealed under purified nitrogen and heated in a 100° C. bath for four hours. During heating, the solution changed from red-orange to dark orange brown. The pulp, slightly changed in color, was collected on a Buchner funnel and the partially reduced polyoxometalate solution (pH=2.05) was saved. 5.33% of the vanadium(V) present, or $2.29\times10^{-4}$ mol V(V) per 1.0 g O.D. pulp, had been reduced to vanadium(IV).

The pulp was washed three times with water and heated for three hours at 85° C. in 1.0% aqueous NaOH at a consistency of 3.2% in an open flask. At the end of this time the alkali solution was light brown. The reduced polyoxometalates in the solution of compound 3 were reoxidized immediately upon addition of oxone (potassium monopersulfate compound) (11.3 mg/per mL solution) at room temperature. The reoxidation was monitored spectrophotometrically and the $^{31}P$ NMR spectrum of the reoxidized polyoxometalate solution was obtained. Two new signals, estimated at approximately 5%, were observed. The new signals may be due to positional isomers of compound 3, but this has not been established.

Figure 3:
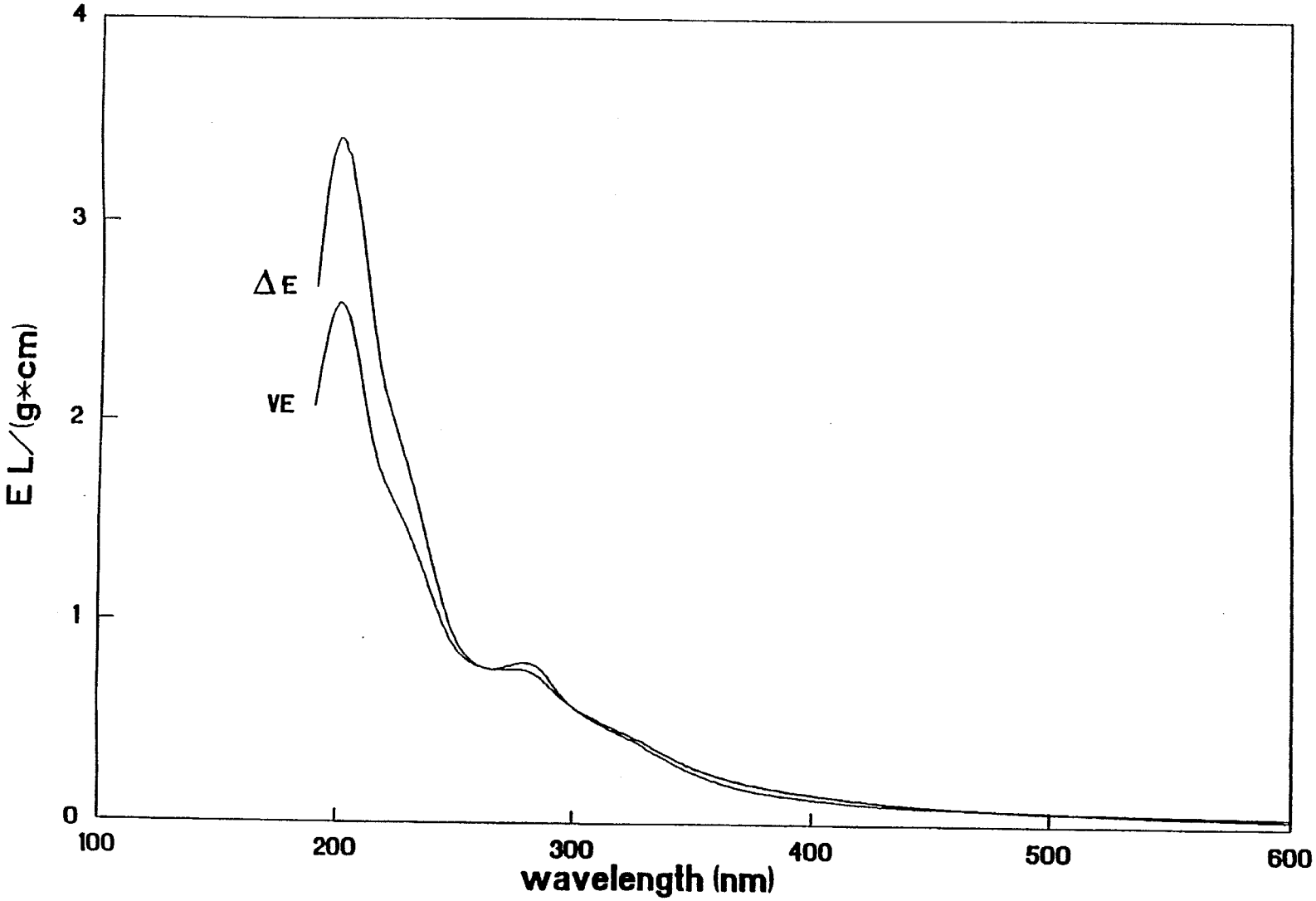
FIG. 3 is a plot of E vs Lambda for pulps obtained after stages VE and ΔE in Example 4.

FIG. 3 is a plot of E versus Lambda for the VE and ΔE stages.

EXAMPLE 5

$Na_6[V_{10}O_{28}]$ (Compound 4)

VE Sequence.

0.10 g oven-dried weight of mixed pine Kraft pulp were added to a 0.10M solution of compound 4 to a final consistency of 2.7% in a 15 mL round-bottomed flask. The pH of the mixture was adjusted to 2.5 with concentrated $H_2SO_4$. Air was removed in three freeze-pump-thaw cycles, and the flask was sealed under purified nitrogen and heated in a 100° C. bath for four hours. During heating the solution changed from orange to red-brown and precipitate of the same color fell out of solution. The mixture of pulp and precipitate was collected on a Buchner funnel and washed with water. Little if any of the precipitate dissolved. The pulp was soaked for 3 hours at room temperature in 1N NaOH to dissolve the precipitated vanadates, washed with water, and extracted for three hours at 85° C. in 1.0% aqueous NaOH. The extract was light brown in color.

Figure 4:
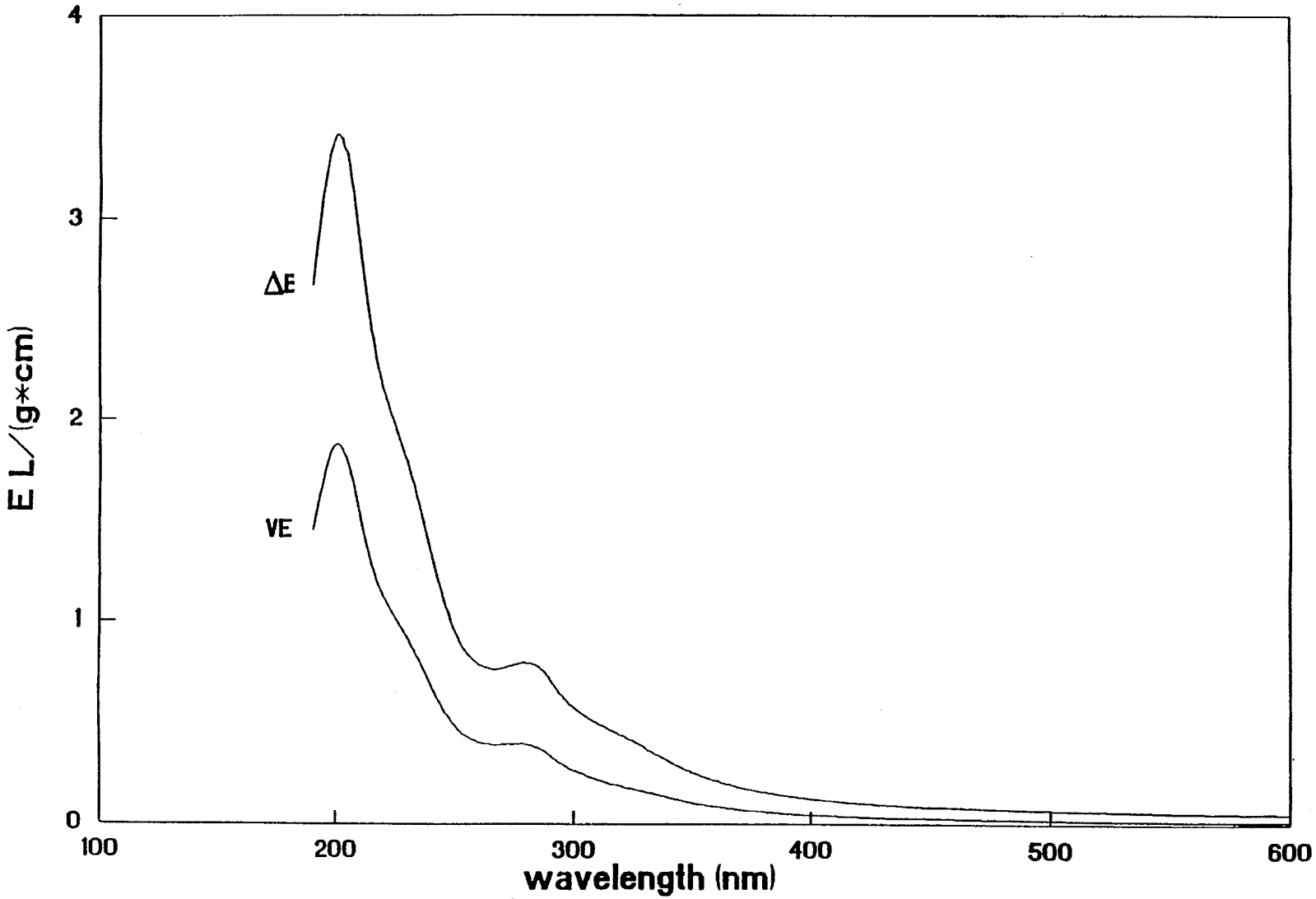
FIG. 4 is a plot of E vs Lambda for pulps obtained after stages VE and ΔE in Example 5.

FIG. 4 is a plot of E versus Lambda for pulps obtained after stages VE and ΔE.

EXAMPLE 6

$\alpha$-$K_5[SiMn(III)W_{11}O_{39}]$ (Compound 6)

$M_1M_2M_3E$ Sequence.

For the $M_1$ stage, 8.5 g (oven dried weight, O.D.) of unbleached kraft pulp was added to a solution of compound 2 in 0.20M acetate buffer to give a final consistency (csc) of 3% (three weight-percent pulp) and a polyoxometalate concentration of 0.05M. The pH after mixing was 5.02. The mixture was then placed in a glass lined Parr high pressure reactor and, while stirred, was purged with purified nitrogen for 40 minutes, sealed, and heated to 125° C. for one hour. During this time, the pH of the polyoxometalate solution dropped to 4.86. The polyoxometalate bleaching liquor was then recovered by filtration and the pulp washed with water.

The amount of compound 6 reduced to compound 5 during the bleaching reaction (stage $M_1$) was determined by reaction of an aliquot of the bleaching liquor with an excess of potassium iodide and titration to a starch endpoint with sodium thiosulfate. Over the course of the bleaching reaction, more than 98.9% of the compound 6 present was reduced to compound 5. Upon cooling the bleaching liquor to 0° C. for three days, 21.02 g of orange crystalline compound 5, characterized by FTIR (KBr pellet), were obtained. The UV-vis spectrum of the supernatant was identical to that of compound 5.

For the $M_2$ stage, 7.36 g O.D. of the $M_1$ stage pulp was reacted as above (3% csc, 0.05M compound 6, in 0.2M acetate buffer) for 1.5 hours at 125° C. under purified nitrogen. At the end of this time, the pH had dropped from 5.14 to 4.95 and 89.2% of the compound 6 present had been reduced to compound 5. This was repeated for the $M_3$ stage using 5.99 g O.D. of pulp from the $M_2$ stage. The reaction was run for two hours during which the pH dropped from 5.16 to 4.89 and 66.8% of the compound 6 present was reduced to compound 5. The UV-vis spectra of the spent M2 and M3 bleaching liquors confirmed the presence of intact, unreacted compound 6. Division of the polyoxometalate treatment into three sequential applications was done here for convenience and to better monitor the bleaching reaction; it is not necessarily a preferential form of the invention.

After the three sequential M stages, an alkaline extraction (E) was performed. 4.69 g O.D. of the $M_3$ stage pulp were heated for two hours under nitrogen at approximately 85° C. as a 2.0% csc mixture in 1.0% sodium hydroxide solution.

A control experiment was performed by subjecting pulp to the same procedure as that described above, but with no polyoxometalate present.

Microkappa numbers of pulp samples after each stage $M_1$, $M_2$, $M_3$ and E, and after the control sequence stages $\Delta_1$, $\Delta_2$, $\Delta_3$ and E, are shown below in Table 5.

TABLE 5

Microkappa numbers of pulps after each stage of the polyoxometalate bleaching and control sequences.

| Sample | Microkappa number |
|---|---|
| Unbleached kraft pulp | 33.6 |
| Polyoxometalate sequence | |
| $M_1$ | 25.5 |
| $M_2$ | 19.6 |

TABLE 5-continued

| Microkappa numbers of pulps after each stage of the polyoxometalate bleaching and control sequences. | |
|---|---|
| Sample | Microkappa number |
| $M_3$ | 13.7 |
| E | 6.5 |
| Control Sequence | |
| $\Delta_1$ | 33.2 |
| $\Delta_2$ | 32.0 |
| $\Delta_3$ | 31.4 |
| E | 29.4 |

Figure 5:
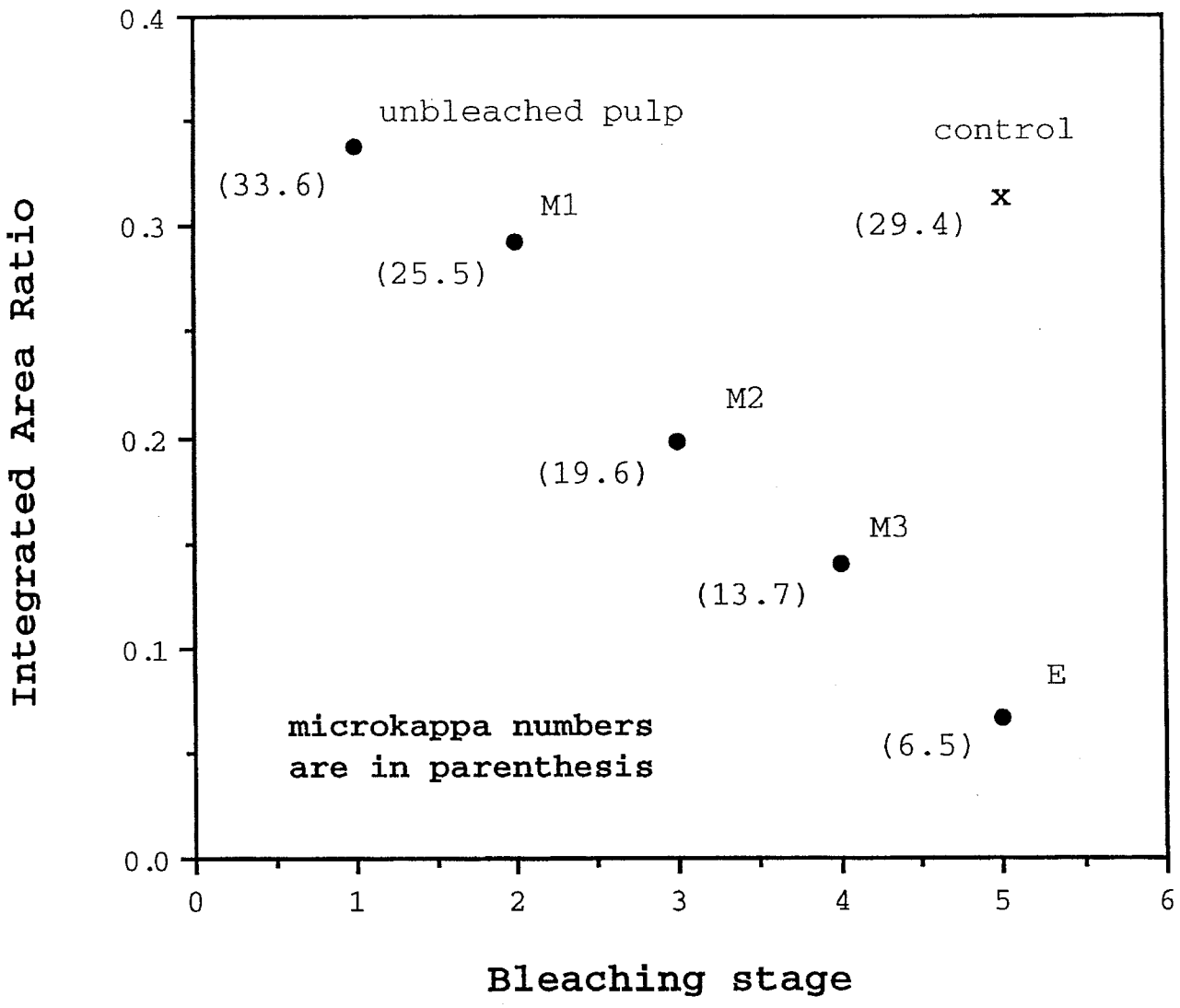
FIG. 5 is a plot of the ratios of integrated areas of the FT Raman bands at 1595 $cm^{-1}$ against those between 1216–1010 $cm^{-1}$ for pulp samples removed after each stage $M_1$, $M_2$, $M_3$ and E of the $M_1M_2M_3E$ bleaching sequence of Example 6, and from a pulp sample examined after completion of the entire $\Delta_1\Delta_2\Delta_3E$ control sequence. The numbers at the bottom of the figure correspond to the four stages of the bleaching reaction with unity reserved for the unbleached pulp. The pulp sample examined after completion of the entire $\Delta_1\Delta_2\Delta_3E$ control sequence is represented by an "x".

FT Raman spectra were obtained from unbleached kraft pulp, from pulp samples removed after each stage $M_1$, $M_2$, $M_3$ and E of the $M_1M_2M_3E$ bleaching sequence, and from a pulp sample examined after completion of the entire $\Delta_1\Delta_2\Delta_3E$ control sequence. FIG. 5 is a plot of the ratios of integrated areas of the FT Raman bands observed at 1595 $cm^{-1}$ against those between 1216–1010 $cm^{-1}$. The plot demonstrates that the concentration of lignin, as represented by the concentration of phenyl groups in the polyoxometalate bleached pulp, decreases dramatically over the course of the $M_1M_2M_3E$ bleaching sequence, while in the control, little change occurs. This demonstrates that the polyoxometalate treatment is cleaving or otherwise removing phenyl groups from the pulp and implies that kappa number determination is a valid criterion for delignification in the polyoxometalate process.

Reoxidation of Used Bleaching Liquors Containing Reduced Polyoxometalates

All of the oxidants mentioned below are thermodynamically capable of reoxidizing all of the reduced vanadium-substituted polyoxometalates. Nonetheless, differences in rates have been observed, and no clear pattern of reoxidation rates is yet discernible. The most desirable oxidants are probably air, oxygen or hydrogen peroxide, with air the most desirable.

EXAMPLE 7

Solutions of $H_5[PV_2Mo_{10}O_{40}]$ (compound 1), partially reduced after reaction with kraft pulps at elevated temperature, were exposed to air as described in Example 1. Moist air was bubbled gently through the dark blue-green polyoxometalate solutions for 1.5 hours at 60° C. During this treatment the blue-green color was discharged to give dark orange solutions that became lighter in color upon treatment with mineral acid. The reoxidation was monitored by UV-vis spectroscopy and, after reoxidation was complete, $D_2O$ was added and $^{31}P$ NMR spectra of the solutions were obtained. Compound 1 exists as a mixture of positional isomers. Although the relative distributions of these isomers changed during bleaching and reoxidation, no new signals were observed.

In addition to air, ozone was also used as a reoxidant. The solutions were exposed to a stream of ozone (0.1 L/min of a 3% mixture of $O_3$ in $O_2$) at 100° C. for several minutes. The result was identical to that obtained upon prolonged exposure to air.

EXAMPLE 8

Solutions of $Na_4[PVW_{11}O_{40}]$ (compound 2), partially reduced after use in bleaching, were not reoxidized at a convenient rate by air or ozone. However, they were readily reoxidized by incremental addition of oxone (potassium monopersulfate compound, Du Pont) at 100° C. Reoxidation was monitored by UV-vis spectroscopy. The integrity of compound 2 was confirmed by $^{31}P$ NMR spectroscopy. Although compound 2 remained largely unchanged, small signals, comprising approximately 5% or less of the sample, were observed. These signals have been tentatively assigned to isomers of $Na_5[PV_2W_{10}O_{40}]$, a close relative of compound 2.

EXAMPLE 9

Solutions of $H_9[P_2V_3W_{15}O_{62}]$ (compound 3), partially reduced after use in bleaching, were not reoxidized at a convenient rate by air, but were reoxidized rapidly, at room temperature, by ozone, and within several minutes at 100° C. after incremental addition of 30% hydrogen peroxide. Reoxidation was monitored visually, and indicated by a change in color of the solution from dark orange-brown to bright red-orange. Two new $^{31}P$ NMR signals, mentioned in Example 3, were observed in roughly the same proportions in solutions reoxidized by either ozone or hydrogen peroxide.

EXAMPLE 10

Selectivity of the Polyoxometalates for Lignin

EXAMPLE 10(a)

Oxidation Potentials of the Vanadium-Substituted Polyoxometalates.

The standard electrode potential for the vanadium(V)/vanadium(IV) couple in 1M acid is +1.00 V versus the normal hydrogen electrode (NHE). This should be compared to the standard potentials for one-electron reductions of $\frac{1}{2}N_2O_4$ (+1.07), $\frac{1}{4}O_2$ (+1.23), $ClO_2$ (+1.27 V), $\frac{1}{2}Cl_2$ (+1.36), $\frac{1}{2}H_2O_2$ (+1.78) and $\frac{1}{2}O_3$ (+2.07), all versus NHE. Although the rates of lignin oxidation by these materials depend upon the mechanism(s) of electron transfer operating in each case, the one-electron redox potentials suggest that vanadium(V) containing polyoxometalates may be more selective than many of the above materials, although somewhat less reactive. At the same time, the reduction potentials listed here show that V(IV) should be capable of reoxidation by all of the oxidants, including oxygen and hydrogen peroxide, commonly used in bleaching. Molybdenum(+6) substituted polyoxometalates are generally somewhat less oxidizing than vanadium(+5) substituted ones. As a consequence, the molybdenum(+6) substituted polyoxometalates should be more selective than the vanadium(+5) substituted ones, and their reduced forms more easily oxidized.

EXAMPLE 10(b)

Oxidation of Model Compounds as a Measure of Selectivity $H_5[PV_2Mo_{10}O_{40}]$ (compound 1), and its sodium salt $Na_5[PV_2Mo_{10}O_{40}]$, oxidize activated phenols to quinones (Lissel, M., et al. *Tet. Lett.*, 33:1795–1798, 1992) and benzylic alcohols to α-ketones (Neumann, R. et al., *J. Org. Chem.*, 56:5707–5710, 1991). Both phenols and benzylic alcohols are constituents of lignin. Significantly, primary alcohols (constituents of cellulose) are not oxidized even after 22 hours at 90° C.

In our hands, 2-methoxy-4-methyl phenol and 4-hydroxy-3-methoxybenzyl alcohol (vanillyl alcohol) were readily oxidized by compound 1, and veratryl alcohol was oxidized to veratryl aldehyde in 30 minutes at 100° C. However, after heating a mixture of compound 1 (10.0 mL of 0.01M solution at pH 1.5) and 0.25 g of cotton cellulose for four hours at 100° C. under anaerobic conditions, only about 0.1% of the polyoxometalate present had been reduced. These results demonstrate that the vanadium-substituted polyoxometalates are highly selective for lignin-derived material, implying that minimal oxidative degradation of cellulosic fibers should occur during the use of these materials in bleaching.

EXAMPLE 10(c)

Selectivity of Compound 6 for Lignin

The intrinsic viscosity of the unbleached kraft pulp was 34.2 mPa.s. After completion of the four stages, the final viscosity of the polyoxometalate bleached pulp (microkappa no. 6.5) was 27.0 mPa.s, while that of the control (microkappa no. 29.4) was 31.3 mPa.s. These results compare favorably with those obtained using elemental chlorine (C), followed by extraction with alkali (E) (traditional chlorine-based bleaching sequence). Using the traditional CE sequence, the kraft pulp used in Example 6 was bleached to a microkappa number of 6.2, comparable to the microkappa no. of 6.5 achieved using compound 6. Notably, however, the intrinsic viscosity of the CE delignified pulp had dropped to 17.9 mPa.s. The higher intrinsic viscosity observed for the polyoxometalate treated pulp demonstrates that, as applied in Example 6, the d-electron-containing transition metal-substituted polyoxometalate (compound 6) is a more selective oxidant than elemental chlorine.

EXAMPLE 11

Oxidation of Compound 5 to Compound 6 with Ozone

Compound 5, and other similar complexes useful in the present invention, are reversible oxidants, able to sustain repeated reduction and reoxidation without undergoing degradative structural changes. This property is not shared by simple transition metal salts, such as those of copper, iron or manganese, that undergo irreversible hydrolysis reactions with water upon oxidation in aqueous media.

The reversible oxidation of a variety of d-electron-containing transition metals in transition metal-substituted polyoxometalates in aqueous solution, by molecular oxygen, hydrogen peroxide and other peroxides, has been reported (Tourné, C. M., et al. *Journal of Inorganic and Nuclear Chemistry,* 32:3875–3890, 1970). In the present invention, ozone was used to oxidize compound 5 to compound 6 prior to bleaching.

Prior to bleaching, compound 5 was oxidized to compound by treatment with ozone gas at room temperature. In a typical preparative reaction, 96.4 g, 0.0298 mol -$K_6[SiMn(II)W_{11}O_{39}].22H_2O$ were dissolved in 150 mL water and the pH adjusted to approximately 2.5 by addition of 2.24 g of glacial acetic acid. The orange solution was then exposed to a dilute mixture of ozone and oxygen gases (3.0–4.0% $O_3$ in $O_2$) introduced via a sparger at a flow rate of approximately 1.0 L/min until the color of the solution had changed to dark purple. During the reaction the pH increased to 5.3. A very slight precipitation of metal oxide was observed in the sintered glass of the sparger. The UV-vis spectrum of the solution was identical to that reported in the literature for $K_5[SiMn(III)(H_2O)W_{11}O_{39}]$, compound 6, and no evidence of permanganate was observed. The solution was then boiled in air to a volume of 50 mL and cooled to 0° C. overnight yielding 81.6 g dark purple crystals. The crystals were dried in a stream of air at room temperature. The Fourier Transform Infra-red (FTIR) spectrum of the crystalline material (KBr pellet) was consistent with that of compound 6. Titration to a starch endpoint using potassium iodide and sodium thiosulfate indicated an effective molecular weight of 3500 amu, which implied the presence of 32 molecules of water per $\alpha$-$[SiMn(III)W_{11}O_{39}]^{5-}$ (compound 6) anion in the crystalline material.

When used in bleaching under anaerobic conditions, the active, oxidized form of the complex, compound 6 in this case, is added to the unbleached pulp. During bleaching, lignin acts as a reducing agent, converting compound 6 back to compound 5. Reduction to compound 5 was followed titrametrically and by isolation and characterization of compound 5 as reported in Example 6.

EXAMPLE 12

Regeneration of Compound 6 After Bleaching

To demonstrate the oxidative regeneration of compound 6, a 25 mL portion of polyoxometalate charged with spent bleaching liquor from the $M_1$ stage of Example 6 was treated with ozone. During the $M_1$ stage, better than 99% of the compound 6 originally present had been reduced to compound 5. Ozone (3.0% $O_3$ in $O_2$) was applied via a sparger to the 25 mL portion at a flow rate of 0.5 L/min for 100 seconds. During this time, the solution changed color from orange to dark purple and the pH rose from 4.9 to 5.5. Titration of the solution to a starch/iodine endpoint with sodium thiosulfate showed that 99% of the oxidizing equivalents expected for complete oxidation of compound 5 to active compound 6, were present. Upon sitting, however, some precipitation of dark brown material, probably hydrated manganese dioxide, was observed. This could mean that slight hydrolytic degradation of compounds 5 or 6 occurred during the $M_1$ bleaching stage. If so, this would indicate that more hydrolytically stable d-electron-containing transition metal-substituted polyoxometalate structures, such as those defined by the General Formula or by Formulas 2–5 in the specification, might be required for commercial application.

EXAMPLE 13

Use of Compounds 1 and 6 in Pulping

Both compounds 1 and 6 were examined for their ability to delignify wood fibers. 3 grams of 96% aspen wood meal (the remaining 4% being water) were heated at 84° C. for 1.5 hours, with stirring and general aeration, in a 0.10M solution of compound 1 at a pH of 0.30. A control was performed by heating 3 grams of 96% aspen wood meal under identical conditions but with no polyoxometalates. The two samples were each subjected to a short kraft cook and the lignin content of each sample was determined.

The lignin contents of the two samples were analyzed according to TAPPI methods T-222 and UM-249. The control sample was found to be 18% delignified, while the sample treated with compound 1 was shown to be 50% delignified.

3.13 grams of 96% aspen wood meal (the remaining 4% being water) were added to a solution of compound 6 in 0.40M acetate buffer to give a final a consistency of 3% and a polyoxometalate concentration of 0.20M. The pH after mixing was 5.25. The mixture was then placed in a glass lined Parr high pressure reactor and, while stirred, was purged with purified nitrogen for 40 minutes, sealed, and heated to 125° C. for one hour (M stage). During this time, the pH of the polyoxometalate solution dropped to 4.46. The polyoxometalate bleaching liquor was then recovered by filtration and the wood meal washed with water. Over the course of the reaction, 96.5% of the compound 6 present was reduced to compound 5. A control (Δ) was performed by heating 3.125 grams of 96% aspen wood meal under identical conditions (0.40M acetate buffer, initial pH=4.75, final pH=4.80) but with no polyoxometalates. The lignin content of each sample was then determined. Then, the two samples were each subjected to a short kraft cook after which the lignin content of each sample was again determined.

The lignin contents of the two samples were analyzed, according to TAPPI methods T222 and um-249 (Klason lignin). The control sample was found to be 2% delignified after the A stage and 14% delignified after the short kraft cook. The sample treated with compound 6 was shown to be 8% delignified after the M stage and 19% delignified after the subsequent short kraft cook (klason lignin).

Another embodiment of pulping using polyoxometalate compounds of the general formula is in the delignification of mechanical pulps. One preferred form is the surface delignification of high pressure mechanical pulp, wherein the energy consumed in preparation of the pulp is low, and the separation of the fibers occurs at the middle lamella between the fibers in the wood chips. Such pulps have fibers with lignin predominant at the surface and, in the absence of delignification treatments, are incapable of sufficient interfiber bonding to allow formation of sheets with adequate properties. Application of a polyoxometalate treatment sufficient to delignify the surface of the fibers will liberate the surface polysaccharide component of the fiber wall and allow it to cause interfiber adhesion resulting in improved mechanical properties.

Because high pressure mechanical pulp is prepared under conditions wherein the energy consumption is low, and internal damage to the fiber structure is more limited, it is anticipated that sheets formed from pulps partially delignified in the manner described above will have superior mechanical properties and will, therefore, be useful in many applications wherein only sheets containing large amounts of chemical pulps are currently used. Such applications include, but are not limited to, packaging, as in grocery bag stock, wrapping papers, corrugated containers and printing papers.

More specifically, this preferred form of the pulping would begin with wood chips that are mechanically fiberized at steam pressures between 50 and 125 psig, depending on species, and treated with a solution of a polyoxometalate of the general formula under the conditions of consistency temperature, pH and polyoxometalate concentration for a period sufficient to remove 5 to 30% of the lignin, depending on species. The fibers would then be submitted to further refining prior to sheet formation.

Another form preferred for other applications would have the delignification proceeding further, to remove more of the lignin and to provide fibers having a higher relative content of polysaccharide. Such fibers would have properties intermediate between those of the pulps described above and those of fully delignified pulps.

We claim:

1. A method for delignifying wood pulp comprising the steps of:

obtaining a wood pulp; and contacting the wood pulp with a solution of a polyoxometalate of the formula $[V_lMo_mW_nNb_oTa_p(TM)_qX_rO_s]^{x-}$ where l is 0–18, m is 0–40, n is 0–40, o is 0–10, p is 0–10, q is 0–9, r is 0–6, TM is a d-electron-containing transition metal ion, and X is a heteroatom, which is a p or d block element, where $l+m+n+o+p \geqq 4$, $l+m+q>0$ and s is sufficiently large that x>0, under conditions wherein said polyoxometalate solution is 0.001 to 0.20M;

the pH of said solution is adjusted to 1.5 or higher;

the consistency of said wood pulp and polyoxometalate solution is approximately 1 to 20%;

said mixtures are heated in a sealed vessel under conditions of temperature and time wherein the polyoxometalate is reduced and enhanced delignification occurs.

2. The method of claim 1 wherein the polyoxometalate is $[V_lMo_mW_n(TM)_oX_pO_q]^{x-}$, where TM is any d-electron-containing transition metal ion, X is a heteroatom, which is a p or d block element, $l+m+n+o=12$, $p=1$, $o \leqq 4$, $l+m+o>0$ and q is sufficiently large that x>0.

3. The method of claim 1 wherein the polyoxometalate is $[V_lMo_mW_n(TM)_oX_pO_q]^{x-}$, where TM is any d-electron-containing transition metal ion, X is a heteroatom, which is a p or d block element, $l+m+n+o=22$, $l+o$ is 1–4, p=2 and q is sufficiently large that x>0.

4. The method of claim 1 wherein the polyoxometalate is $[V_lMo_mW_n(TM)_oX_pO_q]^{x-}$, where TM is any d-electron-containing transition metal ion, X is either $P^{5+}$, $As^{3+}$, or $S^{6+}$, $l+m+n+o=18$, $o \leqq 6$, p=2, $l+m+o>0$ and q is sufficiently large that x>0.

5. The method of claim 1 wherein the polyoxometalate is $[Mo_mW_n(TM)_4X_pO_q]^{x-}$, where TM is any d-electron-containing transition metal ion, X is either $P^{5+}$, $As^{5+}$ or $S^{6+}$, m+n=30, p=4 and q is sufficiently large that x>0.

6. The method of claim 1 wherein the polyoxometalate is of the formula $[V_lMo_mW_n(TM)_oP_5C_pNa_qO_r]^{x-}$, where TM is any d-electron-containing transition metal ion, C is a di- or tri-valent main group, transition metal or lanthanide cation located in the center of the structure, $l+m+n+o=30$, $p+q=1$, $l+m+o>0$ and r is sufficiently large that x>0.

7. The method of claim 1 wherein the polyoxometalate is $\alpha$-$K_5[SiMn(III)W_{11}O_{39}]$.

8. The method of claim 1 additionally comprising the step of reoxidizing the reduced polyoxometalate with an oxidant.

9. The method of claim 8 wherein the oxidant is selected from the group consisting of air, oxygen, peroxide and ozone.

10. The method of claim 8 wherein the step of reoxidizing the reduced polyoxometalate is simultaneous with the step of reducing the polyoxometalate.

11. A method for delignifying wood comprising the steps of:

obtaining a sample of wood fibers; and contacting the wood fibers with a solution of a polyoxometalate of the formula $[V_lMo_mW_nNb_oTa_p(TM)_qX_rO_s]^{x-}$ where l is 0–18, m is 0–40, n is 0–40, o is 0–10, p is 0–10, q is 0–9, r is 0–6, TM is a d-electron-containing transition metal ion, and X is a heteroatom, which is a p or d block element, where $l+m+n+o+p \geqq 4$, $l+m+q>0$ and s is sufficiently large that x>0, under conditions wherein said polyoxometalate solution is 0.001 to 0.20M;

the pH of said solution is adjusted to 1.5 or higher;

the consistency of said wood fibers and said polyoxometalate solution is approximately 1 to 20%;

said mixtures are heated in a sealed vessel under conditions of temperature and time wherein the polyoxometalate is reduced and enhanced delignification occurs.

12. A method for delignifying lignocellulosic fibers comprising the steps of:

obtaining a sample of lignocellulosic fibers; and contacting the lignocellulosic fibers with a solution of a polyoxometalate of the formula $[V_lMo_mW_nNb_oTa_p(TM)_qX_rO_s]^{x-}$ where l is 0–18, m is 0–40, n is 0–40, o is 0–10, p is 0–10, q is 0–9, r is 0–6, TM is a d-electron-containing transition metal ion, and X is a heteroatom, which is a p or d block element, where $l+m+n+o+p \geqq 4$, $l+m+q>0$ and s is sufficiently large that $x>0$, under conditions wherein said polyoxometalate solution is 0.001 to 0.20M;

the pH of said solution is adjusted to 1.5 or higher;

the consistency of said lignocellulosic fibers and polyoxometalate solution is approximately 1 to 20%;

said mixtures are heated in a sealed vessel under conditions of temperature and time wherein the polyoxometalate is reduced and enhanced delignification occurs.

13. A method for delignifying lignocellulosic pulps comprising the steps of:

obtaining a sample of lignocellulosic pulp; and contacting the lignocellulosic pulp with a solution of a polyoxometalate of the formula $[V_lMo_mW_nNb_oTa_p(TM)_qX_rO_s]^{x-}$ where l is 0–18, m is 0–40, n is 0–40, o is 0–10, p is 0–10, q is 0–9, r is 0–6, TM is a d-electron-containing transition metal ion, and X is a heteroatom, which is a p or d block element, where $l+m+n+o+p \geqq 4$, $l+m+q>0$ and s is sufficiently large that $x>0$, under conditions wherein said polyoxometalate solution is 0.001 to 0.20M;

the pH of said solution is adjusted to 1.5 or higher;

the consistency of said lignocellulosic pulp and said polyoxometalate solution is approximately 1 to 20%;

said mixtures are heated in a sealed vessel under conditions of temperature and time wherein the polyoxometalate is reduced and enhanced delignification occurs.

* * * * *